US011076700B2

(12) United States Patent
Kuhl et al.

(10) Patent No.: US 11,076,700 B2
(45) **Date of Patent: *Aug. 3, 2021**

(54) MODULAR SOFA CONSTRUCTION AND METHODS FOR ASSEMBLY

(71) Applicant: Burrow, Inc., New York, NY (US)

(72) Inventors: Stephen Kuhl, New York, NY (US); Kabeer Chopra, New York, NY (US); Leah K. S. Amick, Portland, OR (US); Paul Koh, New York, NY (US); Alex Kubo, Philadelphia, PA (US)

(73) Assignee: Burrow, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/874,147

(22) Filed: May 14, 2020

(65) Prior Publication Data

US 2020/0268160 A1 Aug. 27, 2020

Related U.S. Application Data

(63) Continuation-in-part of application No. 16/595,097, filed on Oct. 7, 2019, which is a continuation-in-part
(Continued)

(51) Int. Cl.

| | |
|---|---|
| ***A47C 13/00*** | (2006.01) |
| ***A47C 17/86*** | (2006.01) |
| ***A47C 17/04*** | (2006.01) |

(52) U.S. Cl.
CPC ..... *A47C 13/005* (2013.01); *A47C 17/04* (2013.01); *A47C 17/86* (2013.01)

(58) Field of Classification Search
CPC ..... A47C 13/005; A47C 17/04; A47C 17/86
(Continued)

(56) References Cited

U.S. PATENT DOCUMENTS

| | | | |
|---|---|---|---|
| 68,389 | A | 9/1867 | Schaefer |
| 321,825 | A | 7/1885 | Koenig, Jr. |

(Continued)

FOREIGN PATENT DOCUMENTS

| | | |
|---|---|---|
| CN | 2852833 | 1/2007 |
| DE | 202016105800 | 11/2016 |
| EP | 1477085 | 11/2004 |

OTHER PUBLICATIONS

Brown, Michael PC World review of PowerCube, PCWorld, Jun. 11, 2014.

(Continued)

*Primary Examiner* — Jose V Chen
(74) *Attorney, Agent, or Firm* — Dentons US LLP

(57) ABSTRACT

A modular sofa assembly described herein includes a plurality of seating modules each having a seat section, a backrest section, and side edge surfaces. The backrest section includes first and second portions coupled for movement between a folded configuration and an extended configuration. An armrest module has an armrest side edge surface configured for mating engagement with a side edge surface of a seating module. The modular sofa is assembled by aligning connectors of the seating modules and armrest module, with each respective connectors slidingly engaged along an axis. After bringing the modules together, these connections are secured with the side edge surfaces in abutting engagement. The modular sofa further may include a power cradle mounted at the sofa's bottom surface. The power cradle includes a cubic power outlet near the front of the sofa, and power cable extending beyond the back of the sofa.

19 Claims, 27 Drawing Sheets

Related U.S. Application Data of application No. 16/252,376, filed on Jan. 18, 2019, now Pat. No. 10,433,648, which is a continuation of application No. 15/419,957, filed on Jan. 30, 2017, now Pat. No. 10,182,659.

(58) Field of Classification Search
USPC ..... 297/217.3, 440.14, 440.2, 440.1
See application file for complete search history.

(56) References Cited

U.S. PATENT DOCUMENTS

| | | | | |
|---|---|---|---|---|
| 2,087,574 | A | 7/1937 | Kaufer | |
| 2,793,685 | A | 5/1957 | Spitz | |
| 3,030,146 | A | 4/1962 | Faxon | |
| 3,658,381 | A | 4/1972 | Grant, Sr. | |
| 3,973,800 | A | 8/1976 | Kogan | |
| 4,074,919 | A | 2/1978 | Watts | |
| 4,311,337 | A | 1/1982 | Brunn | |
| 4,932,720 | A | 6/1990 | Sherman | |
| 5,000,512 | A * | 3/1991 | Laird | A47C 4/02 297/232 |
| 5,352,017 | A | 10/1994 | Berning | |
| 5,544,938 | A | 8/1996 | Saul et al. | |
| 5,671,974 | A * | 9/1997 | Boycott | A47C 7/40 297/440.2 |
| 5,678,897 | A | 10/1997 | Prestia | |
| 5,890,767 | A | 4/1999 | Chang | |
| 5,931,529 | A | 8/1999 | LaPointe et al. | |
| 6,367,880 | B1 | 4/2002 | Niederman et al. | |
| 6,637,812 | B2 | 10/2003 | Laughlin et al. | |
| 6,644,593 | B2 | 11/2003 | Lambiaso | |
| 6,758,450 | B2 | 7/2004 | Niederman et al. | |
| 6,796,614 | B1 | 9/2004 | Paul | |
| 6,839,950 | B2 | 1/2005 | Guillot | |
| 6,932,428 | B2 * | 8/2005 | Murphy | A47C 1/124 297/248 |
| 6,942,298 | B2 | 9/2005 | Harrison | |
| 7,020,911 | B2 * | 4/2006 | Oldham | A47C 13/005 297/411.24 |
| 7,131,701 | B1 | 11/2006 | Yang | |
| 7,143,978 | B2 | 12/2006 | Smallhorn | |
| 7,213,885 | B2 | 5/2007 | White, III et al. | |
| 7,240,967 | B2 | 7/2007 | Wade | |
| 7,347,493 | B2 | 3/2008 | Mulmed | |
| 7,448,689 | B2 | 11/2008 | Carter et al. | |
| 7,547,073 | B2 | 6/2009 | White, III et al. | |
| 7,806,474 | B2 | 10/2010 | Wahl et al. | |
| 7,963,612 | B2 | 6/2011 | Nelson | |
| 8,132,856 | B2 | 3/2012 | Wilson et al. | |
| 8,528,972 | B2 | 9/2013 | Johnsson | |
| 8,646,843 | B2 | 2/2014 | Koch | |
| 8,764,114 | B1 | 7/2014 | Frank et al. | |
| 8,783,778 | B2 | 7/2014 | Nelson et al. | |
| 8,894,138 | B2 | 11/2014 | Monahan | |
| D718,714 | S | 12/2014 | Si | |
| D718,715 | S | 12/2014 | Si | |
| 8,950,817 | B2 | 2/2015 | Iacovoni et al. | |
| 9,028,003 | B2 | 5/2015 | Yeh | |
| 9,277,813 | B2 | 3/2016 | Nelson et al. | |
| 9,277,826 | B2 | 3/2016 | Nelson et al. | |
| 10,182,659 | B2 * | 1/2019 | Kuhl | A47C 17/86 |
| 10,433,648 | B1 * | 10/2019 | Kuhl | A47C 17/86 |
| 2002/0105211 | A1 | 8/2002 | Laughlin et al. | |
| 2005/0067876 | A1 | 3/2005 | Dortch | |
| 2005/0179303 | A1 | 8/2005 | Owens et al. | |
| 2005/0253430 | A1 | 11/2005 | George et al. | |
| 2006/0033368 | A1 | 2/2006 | Longnecker | |
| 2007/0029859 | A1 | 2/2007 | Huang | |
| 2007/0210631 | A1 | 9/2007 | Berning et al. | |
| 2009/0152915 | A1 | 6/2009 | Krasna et al. | |
| 2010/0253127 | A1 | 10/2010 | Haimoff et al. | |
| 2012/0200129 | A1 | 8/2012 | Wilson, Jr. | |
| 2012/0256464 | A1 * | 10/2012 | Chang | A47C 13/005 297/440.16 |
| 2013/0193728 | A1 | 8/2013 | Wang | |
| 2013/0234576 | A1 | 9/2013 | Hixson | |
| 2013/0333940 | A1 | 12/2013 | Stencil | |
| 2014/0208547 | A1 | 7/2014 | Hollins | |
| 2015/0333461 | A1 | 11/2015 | Byrne et al. | |
| 2016/0206100 | A1 | 7/2016 | Nelson et al. | |
| 2018/0000251 | A1 * | 1/2018 | Olsen | A47C 7/002 |
| 2019/0142165 | A1 * | 5/2019 | Nelson | A47C 31/003 297/440.14 |

OTHER PUBLICATIONS

Europe Examination Report dated Jan. 23, 2020 issued in corresponding European Application No. 18 744 395.7, 6 pages.
International Search Report and the Written Opinion dated Apr. 12, 2018 in corresponding Application No. PCT/US18/15198, 14 pages.
Sticky Trigger review of PowerCube, http://www.stickytrigger.com/tech/review-powercube-extended-usb/, Feb. 1, 2017, pp. 1-9.

* cited by examiner

1

Tear off the perforated flap

2

Remove the cushions
and cut open their vacuum seals

3

Align the modules from left
to middle to right and flip open

4

Align the pins and slide
the modules together

5

Align the armrests with the modules,
slide into place, and secure all eight latches

6

Rotate backrest levers down
until you feel a click

7

Place and secure the legs with thumbscrews and plastic plates

8

Align the Power Cube with its mounting dock, keeping the cord to the right side

9

Rotate the Power Cube clockwise to lock in place

10

Secure the cord with two velcro flaps

11

Lift the sofa completely off the ground and set upright, avoiding putting pressure on the back legs

12

Arrange the cushions and relax

MODULAR SOFA CONSTRUCTION AND METHODS FOR ASSEMBLY

CROSS-REFERENCE TO RELATED PATENT APPLICATIONS

This patent application is a continuation-in-part of U.S. patent application Ser. No. 16/595,097 filed Oct. 7, 2019, now U.S. Pat. No. 10,932,580 issued 2 Mar. 2021; which is a continuation-in-part of U.S. patent application Ser. No. 16/252,376 filed Jan. 18, 2019, now U.S. Pat. No. 10,433,648 issued 8 Oct. 2019; which is a continuation of U.S. patent application Ser. No. 15/419,957 filed Jan. 30, 2017, now U.S. Pat. No. 10,182,659 issued 22 Jan. 2019; which are hereby incorporated by reference in their entirety.

TECHNICAL FIELD

The present disclosure relates generally to furniture, such as sofas, and in particular to modular sofa constructions and to methods for assembling modular sofa constructions.

BACKGROUND

A conventional upholstered furniture item, such as a sofa, is typically manufactured from a frame, which is upholstered in a material such as cloth, fabric, leather or the like. This manufacture and assembly occurs at a factory unit. A volume of the completed products are then transported to consumers' premises and/or retail outlets in a common geographical area, typically as a vehicle load by road transport. For large volumes a single goods trailer can be loaded to capacity with said chairs, sofas or sofa beds for delivery to a particular geographical area with the manufacturer waiting until they have sufficient orders for units to fill the trailer to justify the economic cost of sending the trailer to that area. This waiting period can result in delays of days or weeks in the delivery of the items.

A problem with conventional sofas is that these items are relatively bulky and, therefore, can be expensive to transport. The price of sofas and similar upholstered furniture can be significantly increased by the cost of transport, e.g., taking into account related delivery services such as an overnight delivery.

A further problem often experienced by the consumer who purchases a conventional sofa or similar item of furniture from a retail outlet or a manufacturer is logistical challenges in getting the item back to their premises. The consumer may hire or borrow a trailer, van, or roof rack that is large enough to accommodate the item of furniture, or may have to pay for delivery by the supplier. Such arrangements can add cost to the purchase and can be difficult for the consumer to organize. Additionally, the consumer may have difficulty installing the furniture at a desired location without causing damage to the item and/or to the premises; for example if there is a need to remove fittings such as doors windows or the like during the installation.

One approach to addressing the drawbacks of factory assembled furniture items involves providing individually upholstered subcomponents as a ready-to-assemble ("RTA") furniture kit. The individual components can be more efficiently packed, and RTA designs allow the furniture item to be assembled in situ, eliminating the difficulties of navigating the furniture item to an installation site. However, an inherent challenge of RTA furniture kits is that the consumers who assemble the furniture kits are typically untrained and may not have ready access to the tools necessary to assemble the subcomponents. In addition, aligning the heavy subcomponents to install the fasteners for connecting the subcomponents can be difficult, particularly if a single individual is assembling the furniture item. If the fasteners are not properly installed the structural integrity of the furniture item could be compromised resulting in collapse and/or injury of users.

SUMMARY

The modular sofa assemblies described herein attempt to address various commonly encountered problems in transporting and installing furniture items such as sofas. These problems include, for example, difficulties of transporting the furniture item to an installation site, and challenges in assembling the sofa on site such as requirements for special tools or training.

The embodiments described here aim to allow an upholstered sofa to be constructed in a manner that maintains the quality of the sofa while allowing the transport of sofa components in a more economical and prompt manner. A further aim is to ensure that the sofa can be transported more easily upon purchase from a retail outlet or a manufacturer and, upon reaching the premises of intended use, can be relocated within the premises without damage, allowing placement in locations that may not be accessible to conventional sofas. The embodiments described herein can also provide ready-to-assemble furniture kits that can be assembled by users without need for special skills or training.

As described herein, a modular sofa assembly can include one or more seating module having a seat section and a backrest section. The backrest section can include first and second portions coupled for relative pivotal movement between a folded configuration and an extended configuration that provides a substantially contiguous backrest surface. The seating module can include a plurality of seating connectors that extend along a first axis at a seating side edge surface. The modular sofa assembly further can include an armrest module having an armrest side edge surface configured for mating engagement with the seating side edge surface. The armrest module can include a plurality of armrest connectors that extend along a second axis at the armrest side edge surface.

In an embodiment, each seating connector is configured for releasably securing a respective armrest connector, with the seating module and the armrest module in side-by-side relationship. In a secured configuration, the seating side edge surface abuts against the armrest side edge surface. An unsecured configuration permits relative movement of the seating module and the armrest module along the first axis in alignment with the second axis, with each seating connector slidingly engaged with the respective armrest connector.

In an embodiment, the modular sofa includes multiple seating modules with respective seating connectors. Seating connectors of a first seating module are configured for releasably securing respective seating connectors of a second seating module, with the first and second seating modules in side-by-side relationship. In a secured configuration, a side edge surface of the first seating module abuts against a side edge surface of the second seating module. An unsecured configuration permits relative movement of the first and second seating modules along an axis, with each seating connector of the first seating module slidingly engaged with a respective armrest connector of the second seating module.

In an embodiment, the modular sofa assembly incorporates dowel joints that provide releasable connections of seating modules to each other, or to armrest modules. In the dowel joints, a first set of connectors include dowel pins, and a second set of connectors include slots.

In various embodiments, the modular sofa assembly incorporates latch assemblies such as toggle latches, to secure releasable connections of seating modules to each other, or to armrest modules. In an embodiment, toggle latches secure the connections of adjacent modules at a bottom surface of the modular sofa. In various embodiments, the modular sofa assembly incorporates lever clip assemblies, to secure releasable connections of seating modules to each other, or to armrest modules. In an embodiment, lever clip assemblies secure a connection of adjacent modules at a backrest of the modular sofa.

In an embodiment, a modular sofa assembly includes one or more seating module having a seat section and a backrest section. The seating module includes a plurality of seating connectors. The seat section of the seating module includes a bottom surface extending between a back edge and a front edge. An armrest module including a plurality of armrest connectors is configured for mating engagement with the seating module. A power outlet member including an AC power socket is secured to the bottom surface of the seat section adjacent the front edge. An AC power cable is electrically coupled to the AC power socket and extends between the power outlet member and an AC input plug located behind the rear edge of the bottom surface.

In an embodiment, a modular sofa assembly comprises a seating module having a seat section and a backrest section, wherein the backrest section of the seating module comprises first and second portions coupled for relative pivotal movement between a folded configuration and an extended configuration that provides a substantially contiguous backrest surface, and wherein the seating module includes a plurality of seating connectors that extend along a first axis at a seating side edge surface of the seating module; an armrest module having an armrest side edge surface configured for mating engagement with the seating side edge surface of the seating module, wherein the armrest module includes a plurality of armrest connectors that extend along a second axis at the armrest side edge surface of the armrest module, wherein each seating connector of the plurality of seating connectors is configured for releasably securing a respective armrest connector of the plurality of armrest connectors with the seating module and the armrest module in side-by-side relationship, wherein in a secured configuration the seating side edge surface abuts against the armrest side edge surface, and wherein an unsecured configuration permits relative movement of the seating module and the armrest module along the first axis in alignment with the second axis, with each seating connector of the plurality of seating connectors slidingly engaged with the respective armrest connector of the plurality of armrest connectors.

In an embodiment, a modular sofa assembly comprises a seating module having a seat section and a backrest section, wherein the seat section and the backrest section include a folded configuration in which at least a portion of the backrest section is folded against the seating section, and an extended configuration in which the backrest section extends at an angle relative to the section to define a seat surface and a backrest surface, and wherein the seating module includes a plurality of first seating connectors that extend along a first axis at a first seating side edge surface of the seating module, and plurality of second seating connectors that extend along the first axis at a second seating side edge surface of the seating module; a first armrest module having a first armrest side edge surface configured for mating engagement with the first seating side edge surface of the seating module, wherein the first armrest module includes a plurality of first armrest connectors that extend along a second axis at the first armrest side edge surface of the first armrest module; and a second armrest module having a second armrest side edge surface configured for mating engagement with the second seating side edge surface of the seating module, wherein the second armrest module includes a plurality of second armrest connectors that extend along a third axis at the second armrest side edge surface of the second armrest module, wherein each seating connector of the plurality of first seating connectors is configured for releasably securing a respective first armrest connector of the plurality of first armrest connectors with the seating module and the first armrest module in side-by-side relationship, and wherein each seating connector of the plurality of second seating connectors is configured for releasably securing a respective second armrest connector of the plurality of second armrest connectors with the seating module and the second armrest module in side-by-side relationship.

In an embodiment, a modular sofa assembly with integrated power cradle comprises a seating module having a seat section and a backrest section, wherein the seating module includes a plurality of seating connectors, and wherein the seat section of the seating module includes a bottom surface extending between a back edge and a front edge; an armrest module configured for mating engagement with the seating module, wherein the armrest module includes a plurality of armrest connectors configured for releasably securing respective connectors of the plurality of seating connectors; a power outlet member secured to the bottom surface of the seat section adjacent the front edge of the bottom surface, the power outlet module member including an AC power socket; and an AC power cable electrically coupled to the AC power socket of the power outlet member, the AC power cable extending between the power outlet member and an AC input plug located behind the rear edge of the bottom surface.

Other objects, features, and advantages of the present disclosure will become apparent with reference to the drawings and detailed description of the illustrative embodiments that follow.

BRIEF DESCRIPTION OF THE DRAWINGS

Non-limiting embodiments of the present disclosure are described by way of example with reference to the accompanying figures which are schematic and are not intended to be drawn to scale. Unless indicated as representing the background art, the figures represent aspects of the disclosure.

DETAILED DESCRIPTION

Figure 1A:
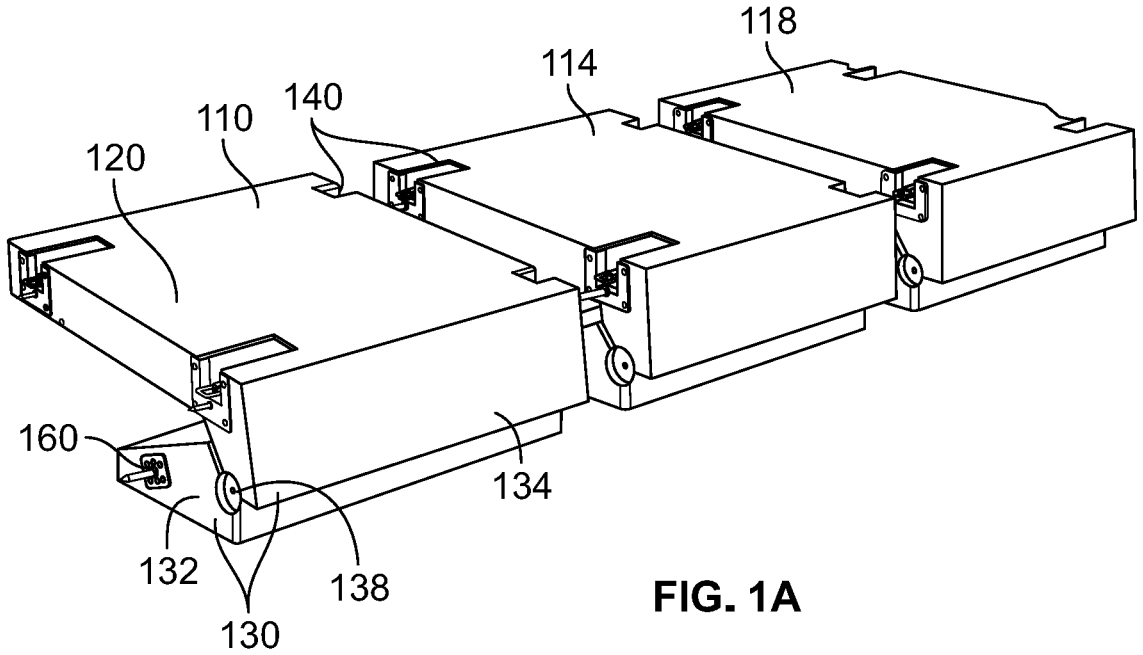
FIG. 1A is a perspective view of a first stage of a sofa assembly procedure, according to an embodiment.

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here. Furthermore, the various components and embodiments described herein may be combined to form additional embodiments not expressly described, without departing from the spirit or scope of the invention.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention.

A sofa includes a seat, a back, and arms. In the modular sofa described herein, components or subassemblies of a sofa are collectively sometimes called "modules." A "seating module" refers to a component that includes a seat (also herein called a seat section) and a back or backrest (also herein called a backrest section). An "armrest module" (also herein called armrest) refers to a component that includes an arm of a sofa. One or more armrest modules can be assembled with one or more seating modules as the subassemblies of a modular sofa.

In various embodiments, the modular sofa includes a plurality of seating modules, such as two or three seating modules. In other embodiments, the modular sofa includes a single seating module. In various embodiments, the modular sofa also includes two armrest modules, referred to herein as a left armrest and a right armrest. In other embodiments, the modular sofa includes a single armrest module. In the embodiment of FIGS. 1A-1H, the modular sofa 100 includes three seating modules (left, middle, and right) and two armrest modules (left and right).

FIGS. 1A-1H show a procedure for assembling a modular sofa. The procedure of FIGS. 1A-1H illustrates the ease of assembling a modular sofa, e.g., after modules have been shipped to a location and unpacked. The seating modules and armrest modules, as well as ancillary components such as sofa legs and cushions, may be shipped in separate containers. Various components, such as a seating module and its associated cushions, may efficiently be combined in a container. These modules are designed to be shipped in compact configurations of moderate weight for ease of transportation and handling. Upon reaching the premises at which the sofa is to be installed, the modules can be moved within the premises without damage, facilitating placement of the sofa in locations that may not be easily accessible to conventional sofas. Furthermore, the sofa's modular construction is suitable for assembly without special tools or training.

Figure 1B:
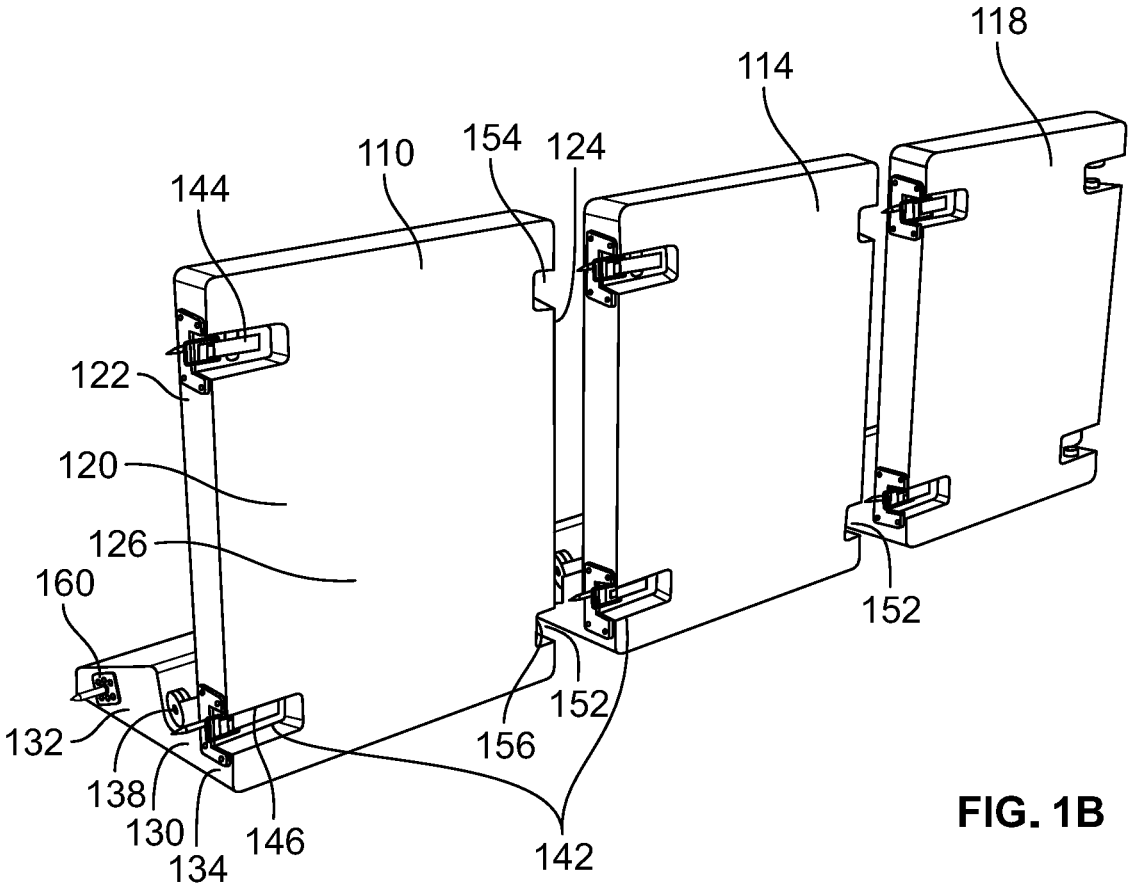
FIG. 1B is a perspective view of a second stage of a sofa assembly procedure, according to the embodiment of FIGS. 1A-1H.
Figure 1C:
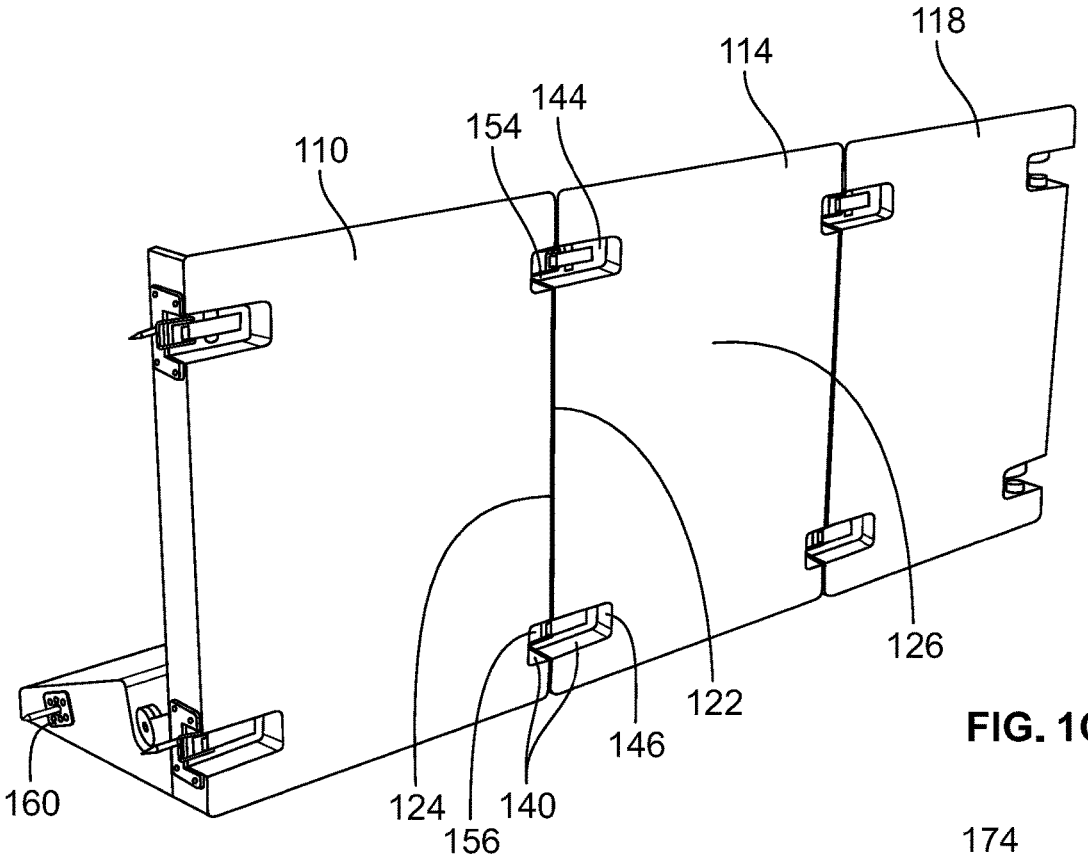
FIG. 1C is a perspective view of a third stage of a sofa assembly procedure, according to the embodiment of FIGS. 1A-1H.
Figure 1D:
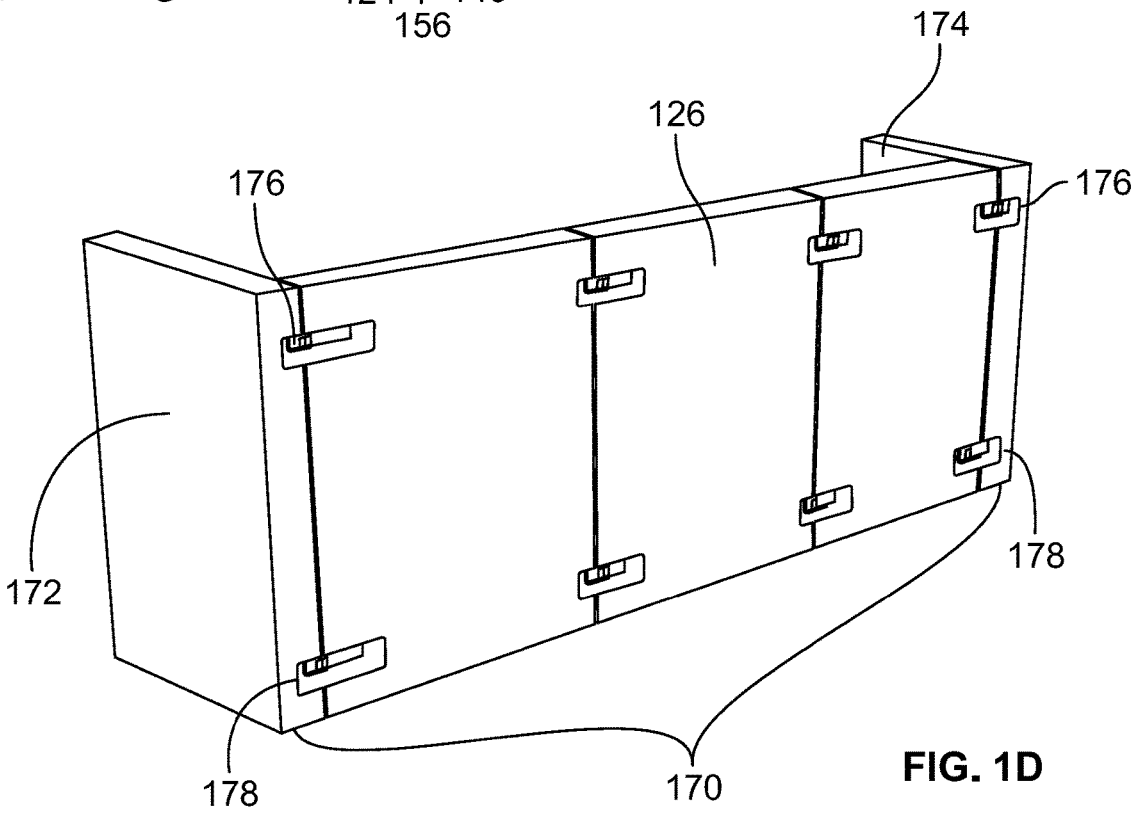
FIG. 1D is a perspective view of a fourth stage of a sofa assembly procedure, according to the embodiment of FIGS. 1A-1H.
Figure 1E:
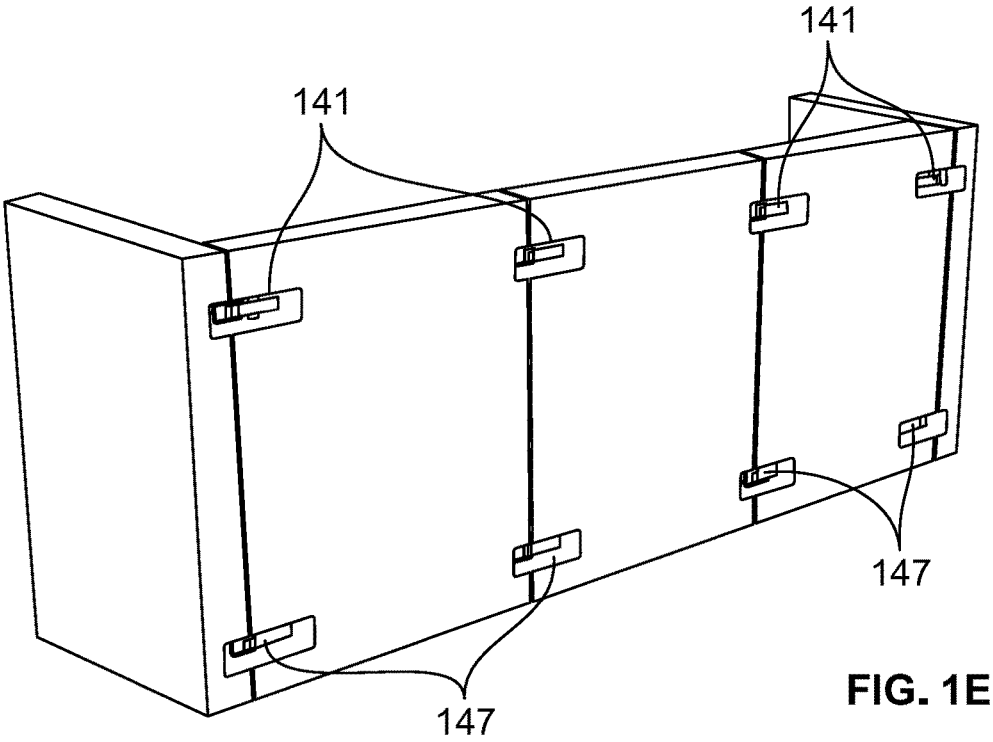
FIG. 1E is a perspective view of a fifth stage of a sofa assembly procedure, according to the embodiment of FIGS. 1A-1H.
Figure 1F:
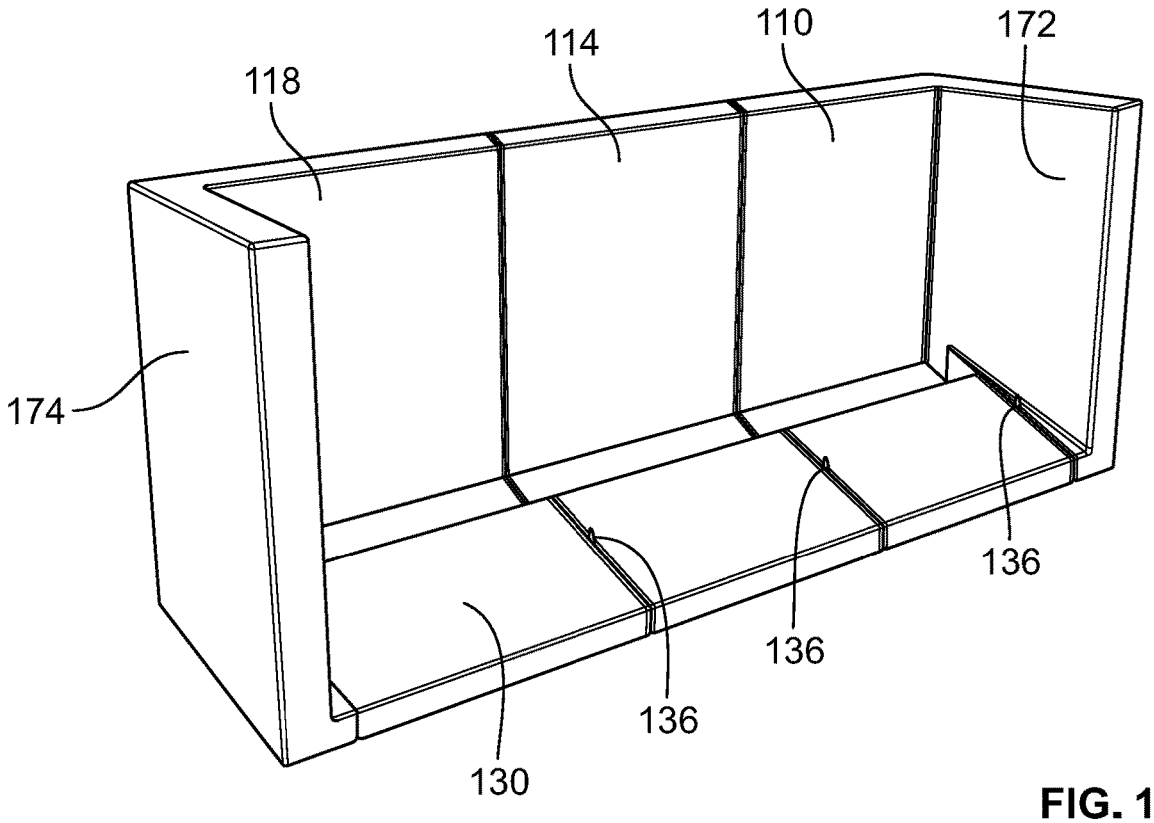
FIG. 1F is a perspective view of a sixth stage of a sofa assembly procedure, according to the embodiment of FIGS. 1A-1H.
Figure 1G:
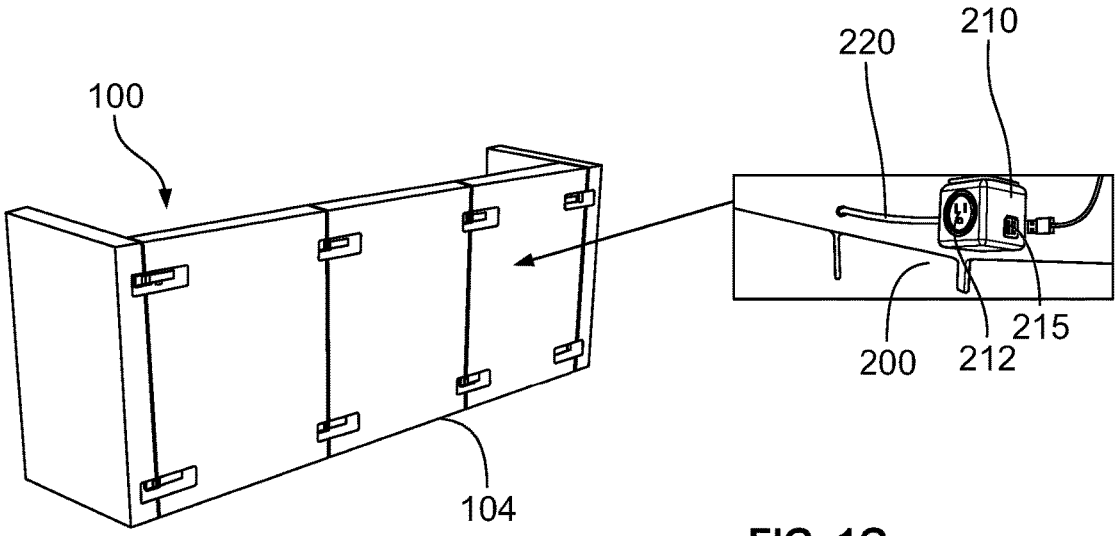
FIG. 1G is a perspective view of a seventh stage of a sofa assembly procedure, according to the embodiment of FIGS. 1A-1H.
Figure 1H:
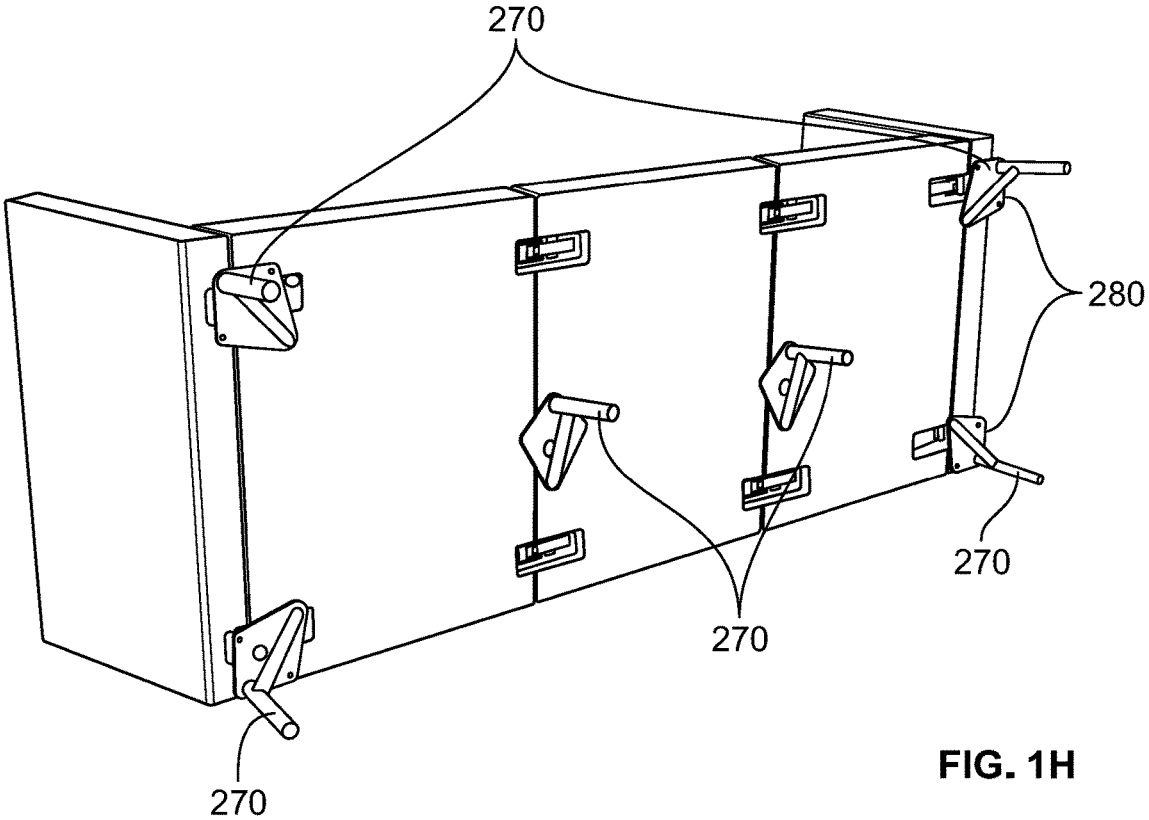
FIG. 1H is a perspective view of an eighth stage of a sofa assembly procedure, according to the embodiment of FIGS. 1A-1H.

Additionally, FIGS. 1G and 1H illustrate a power cradle (also herein called power cradle assembly) for a modular sofa. The power cradle provides convenient access to power outlets at the bottom front of the sofa, where the power outlets are less visible than other locations on the sofa, rather than needing to access wall power sockets behind the sofa or on a wall near the sofa.

In the first assembly state shown in FIG. 1A, seating modules 110, 114, and 118 are shown in their configurations as shipped, after removal from packaging. First or left seating module 110, second or middle seating module 114, and third or right seating module 118, all are shown resting on a portion 132 of their backrest sections, with their seat sections 120 facing upwards. The backrest section 130 includes an upper portion 132 and a lower portion 134, which are oriented approximately 90° relative to each other as seen in this shipment configuration, also called folded configuration. The lower backrest portion 134 is joined to the seating section 120 at a fixed angle, here shown as an approximately 90° angle. Thus, in the folded configuration of the seating modules, the backrest upper portion 132 of backrest section 130 is folded against and approximately parallel to the seat section 120, providing a compact configuration for shipment. Upon removing the folded seating modules from packaging, the user rests the seating modules on their upper backrest portions 132 in a side-by-side arrangement.

The upper and lower backrest portions 132, 134 are coupled to each other for relative pivotal movement at hinge 138. The seating modules include a plurality of seating connectors 140 used in assembling the seating modules to each other and to armrest modules (not shown in FIG. 1A). The seating modules further include back clips or back connectors 160, which are also used in assembling the seating modules to each other and to armrest modules.

As used herein, "connectors," such as seating connectors 140 and back connectors 160, are mechanisms configured to hold together adjacent modules of modular sofa 100 in a side-by-side relationship. Individual connectors may be referred to as "clips," and two joined connectors may be referred to as a clip. "Side edge surfaces" of seating modules and armrest modules may refer to surfaces that face to the left or to the right when the modules are in their normal use configurations in modular sofa 100. In an embodiment, side edge surfaces are substantially planar surfaces configured for side-by-side abutting engagement when adjacent modules are assembled and secured to each other.

Ordinal numbers, such as first and second, are sometimes used to distinguish between left connectors and right connectors of a seating module, or between connectors of different modules. Given ordinal numbers (e.g., first seating connectors) may refer to left or right connectors, or connectors of different modules, depending on context. Similarly, a given ordinal number in referring to an axis along which particular connectors extend (e.g., first axis) may refer to axes of different connectors or different modules, depending on context. Ordinal numbers, such as first and second, are sometimes used to distinguish between left side edge surfaces and right side edge surfaces of a seating module, or between side edge surfaces of different modules. Given ordinal numbers (e.g., first side edge surface) may refer to left or right side edge surfaces, or side edge surfaces of different modules, depending on context.

Various directional terms, such as right, left, upper, lower, top, bottom, and middle, are based on a perspective of a modular sofa standing in its normal orientation during use as viewed from the front. These directional terms are retained when viewing the sofa, or parts or subassemblies of the sofa, from other perspectives. For example, in FIG. 1D in which a partially assembled sofa is resting on its backrest with the bottom facing forward, armrest 172 is the left armrest, armrest 174 is the right armrest, and the surface 126 facing the viewer is the sofa bottom. In the view of FIG. 1F in which the sofa is resting on its backrest with the top of the seat facing forward, the positions of the right and left armrests 174, 172 are inverted but they are identified using the same directional terms as in FIG. 1D.

At the second assembly stage seen in FIG. 1B, the user unfolds the modules 110, 114 and 118 so that the upper portion 132 and bottom portion 134 of each backrest are in line, and the modules rest on the unfolded backrest section 130. In this configuration, the seat sections 120 are upright with the bottom surface 126 of each seating module facing forward.

Module 110 includes seating connectors 144, 146 at the left edge surface 122 and seating connectors 154, 156 at the right edge surface 124. More generally, each of the seating modules includes two left seating connectors 142 at the left edge surface of the seating section 120. In an embodiment, one connector is located toward the front of the seating section and one is located toward the back of the seating section 120. Each of the seating modules includes two right seating connectors 152 at the right edge surface of that seating section 120. In an embodiment, one connector is located toward the front of the front of the seating section 120 and one is located toward the back of the back of the seating section 120. Additionally, each of the seating modules includes one back connector 160 at the left edge surface 122 in the backrest section 130, and one back connector 160 at the right edge surface 124 in the backrest section 130 (not visible in FIG. 1B).

At the third assembly stage shown in FIG. 1C, the user aligns connectors 140, 160 of adjacent modules with each other. The user then pushes together the adjacent modules together to bring facing side edge surfaces into abutting engagement. As further described below, seating connectors 140 and back connectors 160 are configured to facilitate alignment of corresponding connectors, and to facilitate moving adjacent modules together.

At the fourth assembly stage shown in FIG. 1D, the user orients and aligns the left armrest module 172 with left seating module 110 and orients and aligns the right armrest module 174 with the right seating module 118. The user then moves each armrest module together with the adjacent seating module to bring facing side edge surfaces into abutting engagement.

At the fifth assembly stage shown in FIG. 1E, the user secures the connectors or clips joining adjacent modules (172, 110, 114, 118, 174). In an embodiment, in the secured configuration, the side edge surface of each armrest abuts against the side edge surface of the adjacent seating module, and facing side edge surfaces of adjacent seating modules abut against each other. In an embodiment as further described below, seating connectors 140 include latch mechanisms used in securing the seating connectors. In another embodiment as further described below, seating connectors 140 include threaded fasteners used in securing the seating connectors.

At the sixth assembly stage shown in FIG. 1F, the user flips pivotally mounted levers 136 between adjacent backrest sections, and between backrest sections and adjacent armrest modules 172, 174. Levers 136 are components of back connectors or back clips 160, and closing these levers secures the connections of back clips. Back connectors 160 with levers 136 between backrest sections provide a low profile mechanism that does not mar the backrest surface of the assembled modular sofa 100.

At the seventh assembly stage shown in FIG. 1G, the user mounts elements of the power cradle 200, including power outlet member and AC power cable (also herein called power cord), to the bottom surface 126 of sofa module 100. In this embodiment, the user mounts a cubic power outlet 210 (also called power cube) to bottom surface 126 near the front edge of the sofa, and mounts the power cable 220 extending from power cube 210 toward edge of the sofa. Cubic power outlet 210 may include AC power sockets 212 and a charging port 215. Although shown and described as having a "cubic" shape, power outlet 210 can be configured using any variation for providing a power source and for attaching to the bottom surface 126 of the sofa.

At the eighth assembly stage shown in FIG. 1G, the user attaches legs 270 to sofa bottom 126 using mounting hardware 280. In an embodiment, the user attaches leg assemblies 270, 280 at the four corners of modular sofa 100, and two additional leg assemblies 270, 280 at central locations between the seating modules 110, 114 and between the seating modules 114, 118. In an embodiment, the mounting hardware 280 includes fasteners such as thumb screws that do not require tools to mount the leg assemblies to sofa bottom 126. Following this eighth stage, the user then repositions the sofa right side up (not shown). In an embodiment, the user then places cushions on such as seat cushions and back cushions on the sitting surface and backrest surface of the sofa 100 (not shown).

Figure 2:
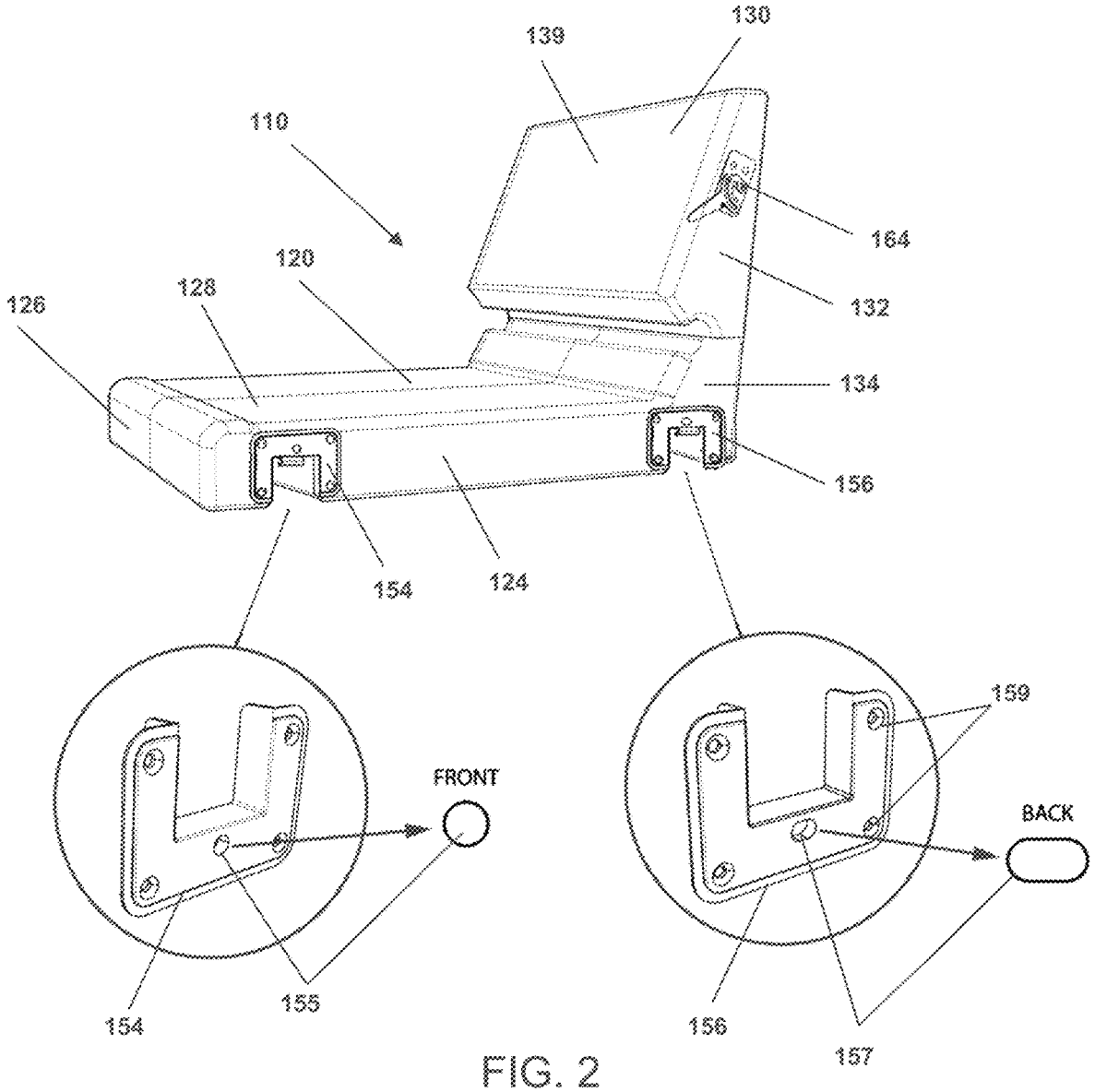
FIG. 2 is an isometric view of a seating module viewed from the right side, with close-up end views of second seat clips, according to an embodiment.

FIGS. 2-7B are perspective views of seating modules, armrest modules, and close-up views of connectors of these modules, in various embodiments. FIG. 2 shows seating module 110 viewed from the right side, with close-up end views of seat clips 154, 156. The seating module includes seat section 120 with an upper, sitting surface 128, a front edge surface 126, and a right edge surface 124. The seating module further includes a backrest section 130, including upper portion 132 and lower portion 134 in line. In an embodiment, the backrest section has a front facing angled surface 139 that provides comfortable back support. Seat connectors 154, 156 are located at seat 120 respectively toward the front and rear of the right edge surface 124, and back connector 164 is located at the right edge surface of backrest 130. As seen in a close-up view, connector 154 includes a mounting slot 155 and seat connector 156 includes a mounting slot 157. In an embodiment, mounting slot 155 is round while mounting slot 157 is oblong, to distinguish between the connectors toward the front and rear respectively. In an embodiment connectors 154 and 159 also include hardware, such as fasteners (not shown) inserted in mounting holes 159, for attaching these connectors to the seating module 110.

Figure 3:
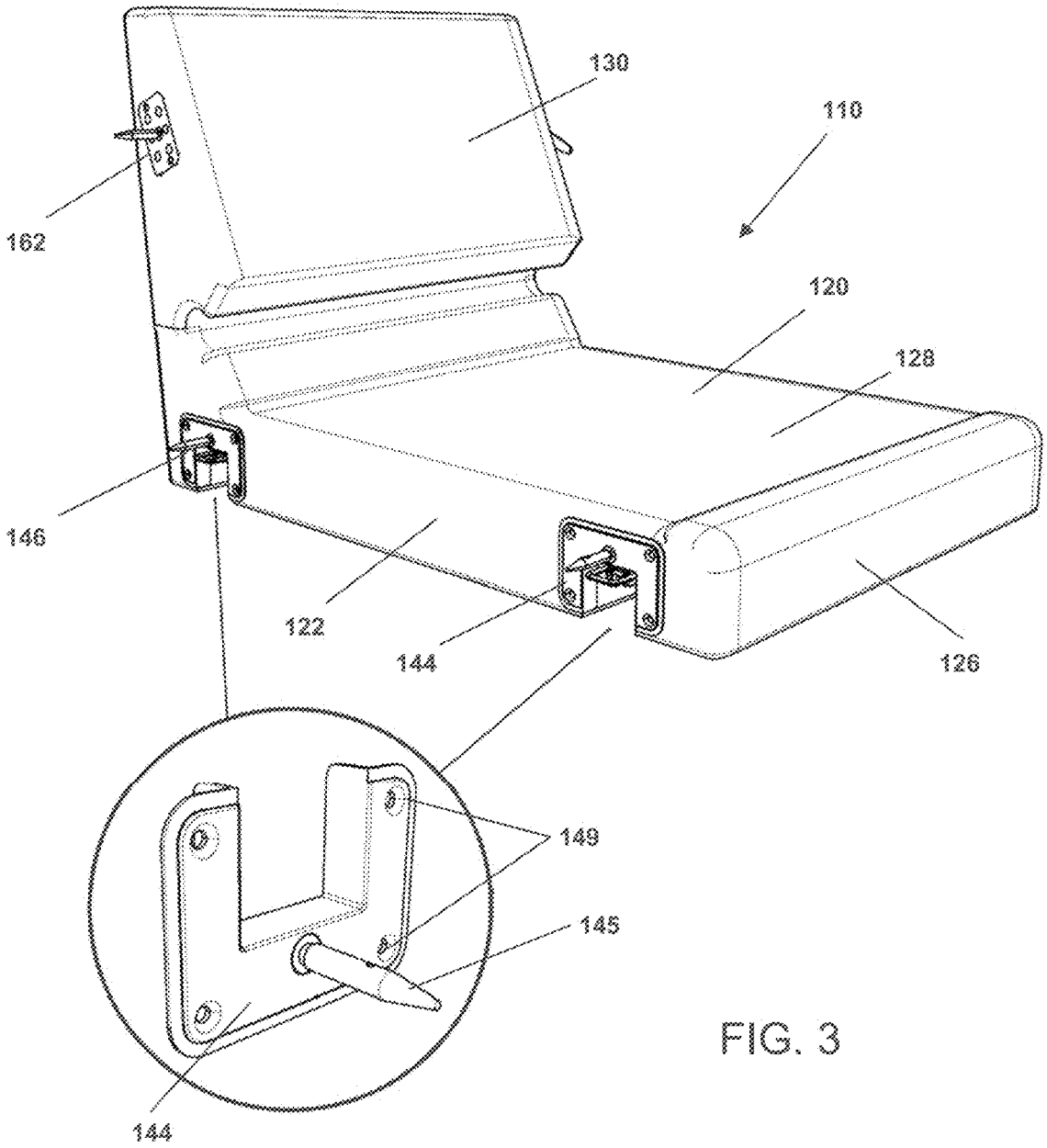
FIG. 3 is an isometric view of a seating module viewed from the left side, with a close-up end view of first seat clips, according to an embodiment.

FIG. 3 shows a seating module viewed from the left side, with close-up end view of first seat clips 144, 146. Seat connectors 144, 146 are located at seat 120 respectively toward the front and rear of the left edge surface 122. Back connector 162 is located at the right edge surface of backrest 130. As seen in a close-up view, connector 144 includes a mounting pin 145 protruding (e.g., at 90°) from the connector's external surface. In an embodiment connector 144 also include hardware, such as fasteners (not shown) inserted in mounting holes 199, for attaching these connectors to the seating module 110. In an embodiment, connector 146 has the same configuration as connector 144.

In an embodiment, the connectors 144, 146 and connectors 154, 156 incorporate a dowel pin mechanism for coupling adjacent modules. Mounting pins 145 (also called dowel pins) extend along a first axis, e.g., at a substantially 90° angle from the side edge surface 122. Mounting slots 155, 157 extend along a second axis, e.g., at a substantially 90° angle from the side edge surface 124. As used in the present disclosure, a "slot" may refer to an opening that extends along an axis, or may refer to an aperture at the surface of a module, depending on context. In aligning and joining connectors 144, 146 to connectors 154, 156, the user aligns the pins and slots and thereby aligns the first axis with the second axis. The user may then easily move the seating modules including these respective connectors together, via sliding relative movement of the connectors.

This assembly stage, e.g., shown in FIG. 1C, is sometimes called the unsecured configuration of the connectors. In an embodiment, in the unsecured configuration the connectors provide prismatic joints (one degree-of-freedom, sliding joints) between adjacent modules. Due to the prismatic joints the user can easily slidingly join, or slidingly separate, adjacent modules. In an embodiment, the connectors also include compression springs (not shown), that bias the connectors to separate the modules, absent a clamping force.

Figure 4A:
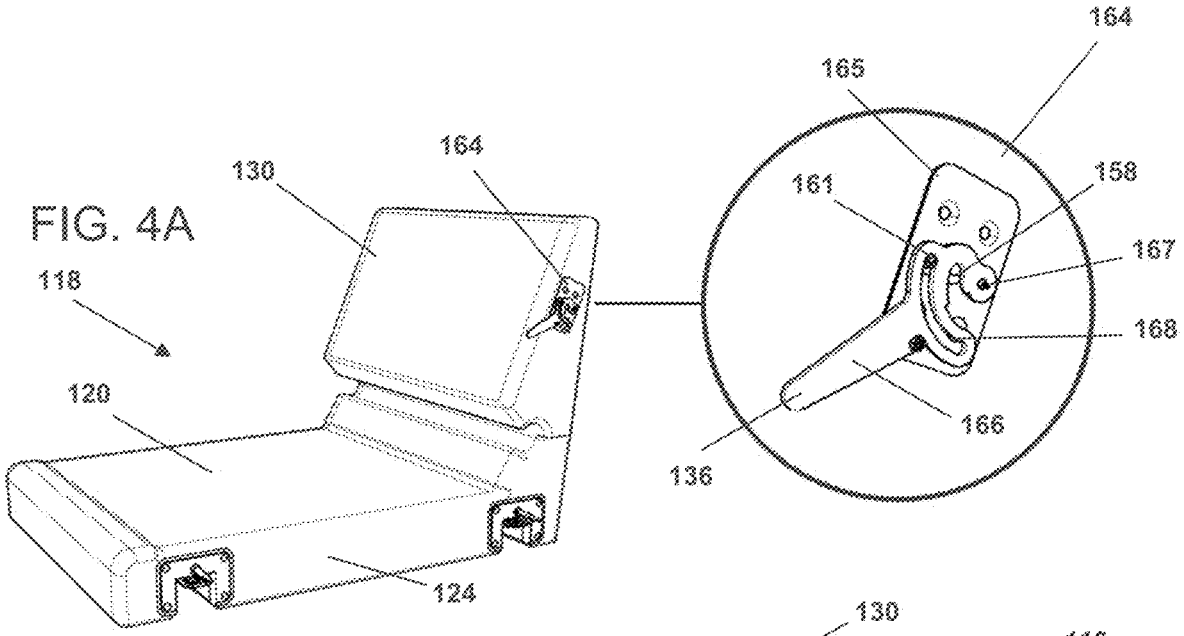
FIG. 4A is an isometric view of a seating module viewed from the right side, with a close-up end view of a second back clip, according to an embodiment.
Figure 4B:
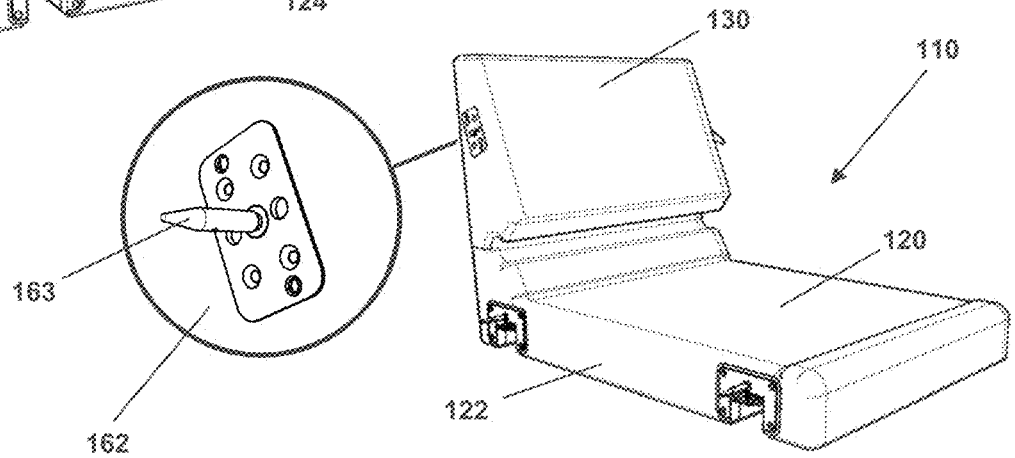
FIG. 4B is an isometric view of a seating module viewed from the left side, with a close-up end view of a first back clip, according to an embodiment.

FIG. 4A shows a seating module 118 viewed from the right side, with a close-up end view of a first back clip 164, while FIG. 4B shows a seating module 110 viewed from the left side, with a close-up end view of a second back clip 162. First back clip 164 and second back clip 162 respectively include a mounting slot 163 and mounting pin 161 forming a dowel pin joint. Back connector 164 includes a lever clip assembly 166 pivotally mounted on base plate 165 at pivot 167. When a user flips lever 136, lever clip assembly 166 moves pivotally between a closed position shown in FIG. 4A and an open position. Lever clip assembly 166 includes an arcuate channel 168 that in cooperation with guide 161, guides this pivoting motion. In the open position, the back connectors 162 and 164 are in unsecured configuration in which the dowel pin 163 may slide within mounting slot 158. In the closed position, the back connectors 164 locks the dowel pin 161 in its fully inserted position within slot 158. In an embodiment, a compression spring (not shown) biases the connector 162 to withdraw the pin 163 from slot 158, absent a clamping force.

In an embodiment, the first back clip 164 is always located on the right side of seating modules 110, 114, 118, and second back clip 162 is always located on the left side of seating modules 110, 114, 118. In this embodiment, the left armrest module may include a back clip of the same configuration as the first back clip 164 (e.g., as shown at 180 in FIG. 7A), and the right armrest module may include a back clip of the same configuration as the second back clip 162 (e.g., as shown at 188 in FIG. 7B).

Figure 5B:
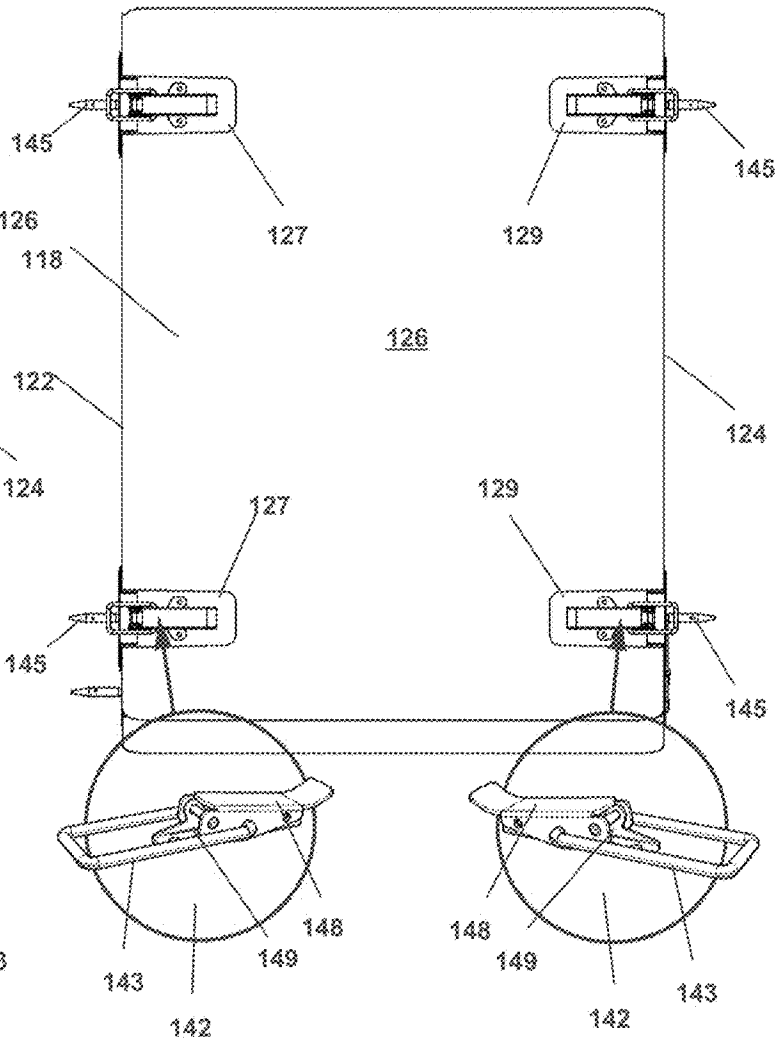
FIG. 5B is a schematic bottom view of a second seating module configuration, with perspective view of associated seat clips, according to an embodiment.
Figure 5A:
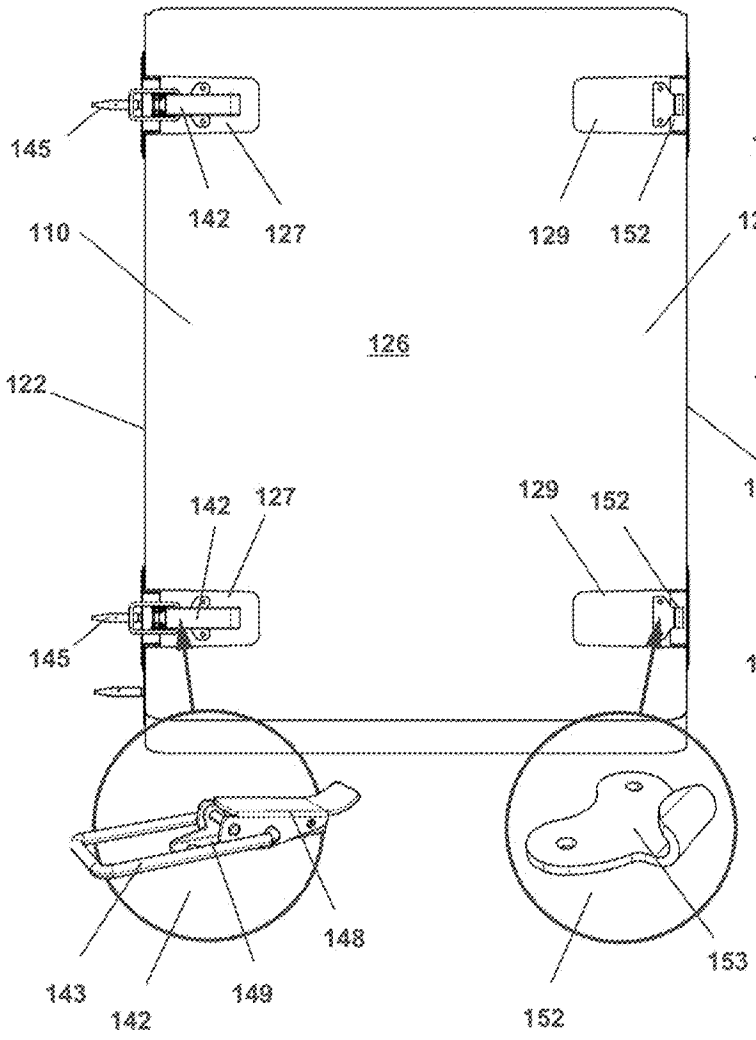
FIG. 5A is a schematic bottom view of a first seating module configuration, with perspective view of associated seat clips, according to an embodiment.

FIG. 5A shows a first seating module configuration as viewed from the bottom, with perspective views of associated seat clips. Left seating connectors 142 are mounted at indentations 127 bordering the left edge surface 122 of the seating module's bottom surface 126, while right seating connectors 152 are mounted in indentations 129 bordering the right edge surface 124 of bottom surface 126. In the configuration of FIG. 5A, the left seat connectors 142 include a toggle latch mechanism as seen in the perspective view of connector 142. The toggle latch mechanism includes a hook 143 configured to engage a mating catch (e.g., catch 153, also herein called strike). Hook 143 is mounted to a spring loaded toggle arm 148, supported on latch base 149. Connectors 142 also incorporate dowel pins 145, e.g., as seen in FIG. 3. In the configuration of FIG. 5A, the right seat connectors 152 each comprise a catch or strike 153, including a lip configured to engage and hold the clip 143 of the toggle latch. Connectors 152 also incorporate mounting slots, e.g., as shown at 155, 157 in FIG. 2. In an embodiment, this first seating module configuration may be used for the left seating module 110 and middle seating module 114.

Figures 7A, 7B:
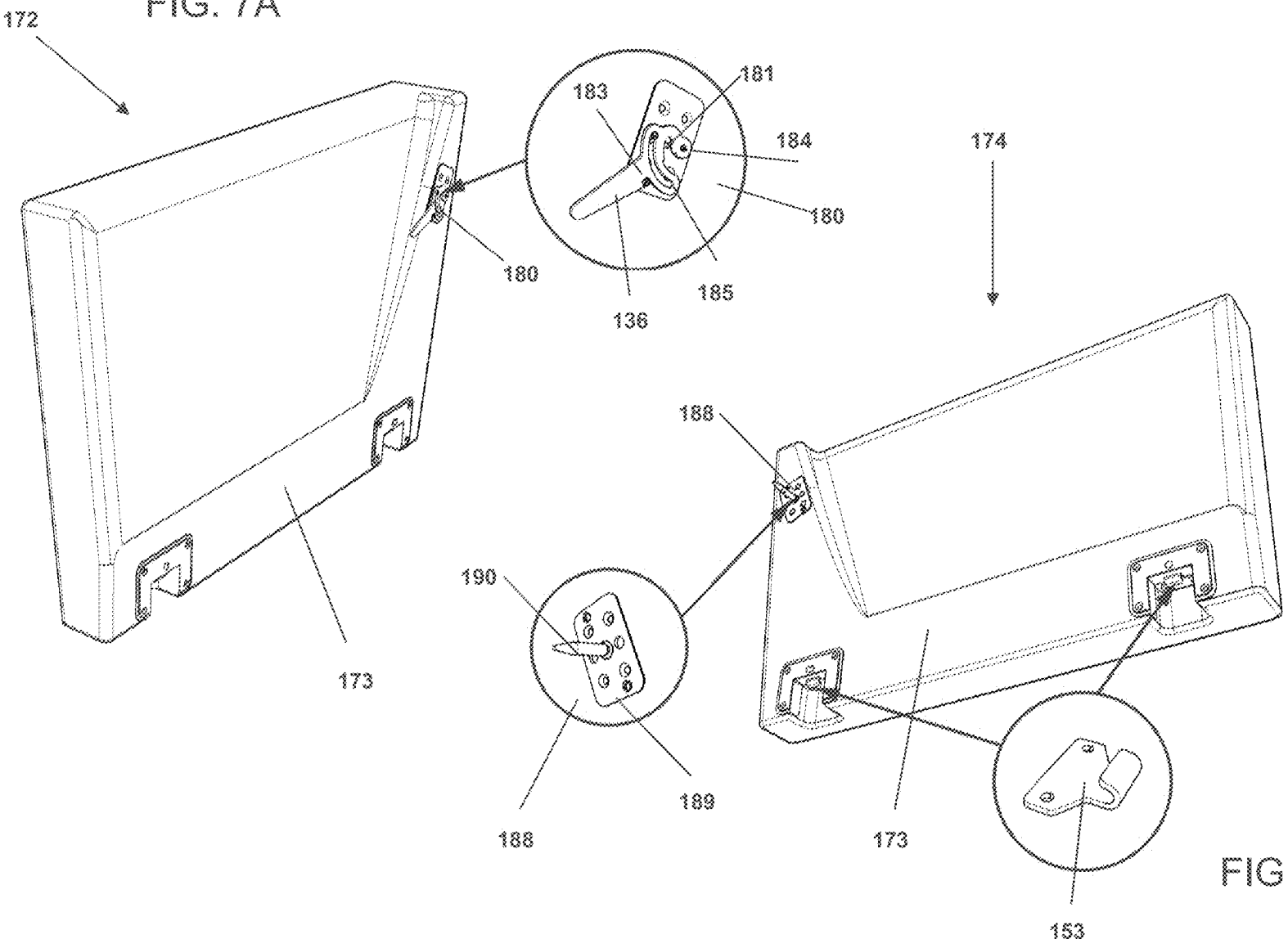
FIG. 7A is a perspective view of the inner edge of the left armrest module, with close-up end view of a left armrest back connector, according to an embodiment.
FIG. 7B is a perspective view of the inner edge of the right armrest module, with close-up end view of a right armrest back connector, according to an embodiment.

FIG. 5B shows a second seating module configuration as viewed from the bottom, with perspective view of associated seat clips. The seating module configuration is the same as FIG. 5A, except that both the left seat connectors and right seat connectors have the pin/latch connector configuration of connectors 142. In an embodiment, this second seating module configuration may be used for the right seating module 118, so that the right seat connectors can be joined to a right armrest 174 with slot-catch connectors, e.g., as shown in FIG. 7B. This embodiment incorporates slot-catch connectors in both armrests 172, 174 in order to reduce the widths of these modules, as the slot-catch connectors have a narrower footprint than the pin-latch connectors.

Figure 6:
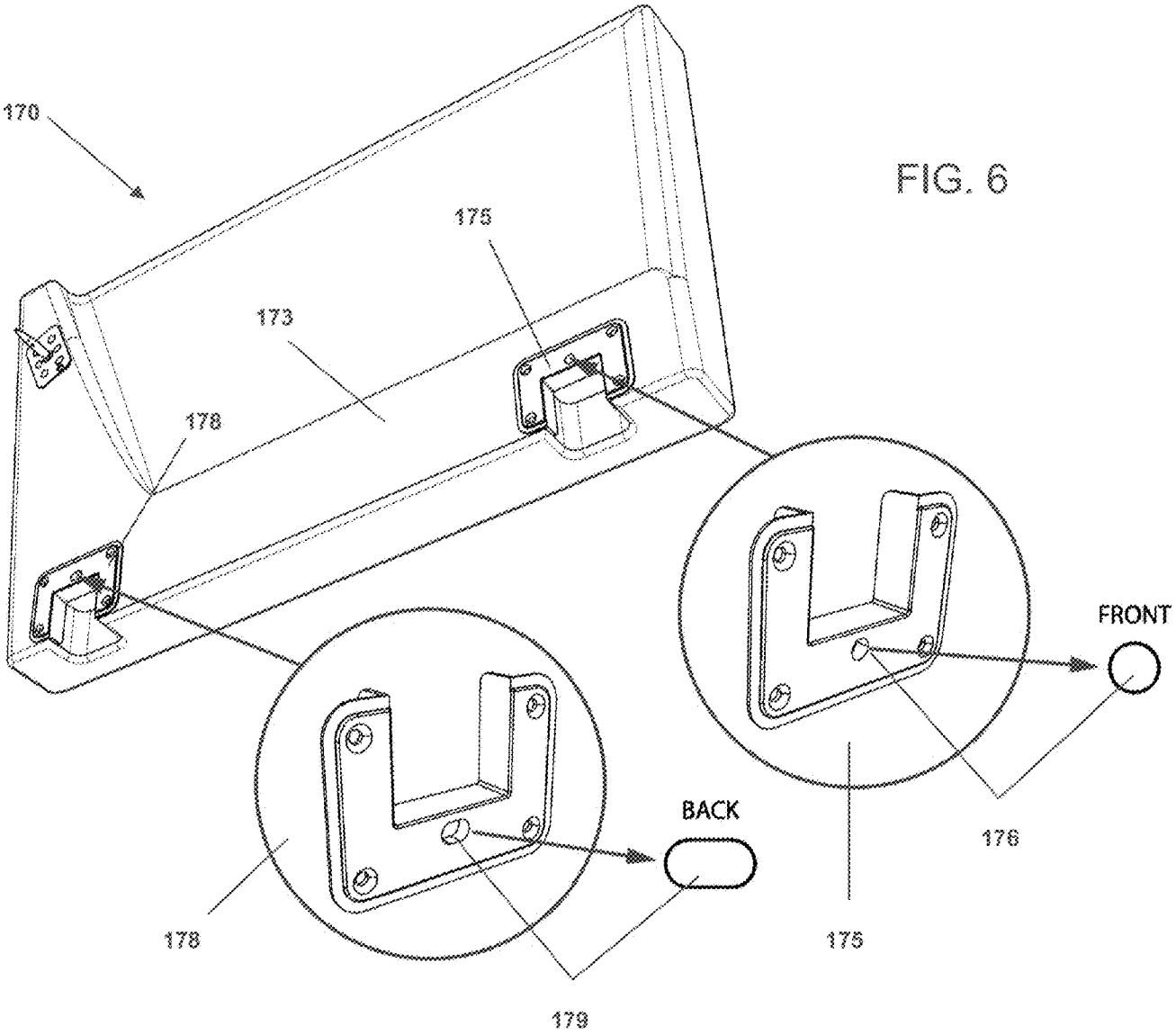
FIG. 6 is a perspective view of the inner edge of an armrest module, with close-up end views of armrest seat connectors, according to an embodiment.

FIG. 6 shows the inner edge of an armrest module 170, with close-up end views of armrest seat connectors. Armrest module 170 includes a side edge surface that is configured for abutting engagement with a side edge surface of an adjacent seating module. Armrest connectors 175, 178 are located respectively toward the front and rear of the side edge surface 173. As seen in a close-up view, armrest connector 178 includes a mounting slot 179 and armrest connector 175 includes mounting slot 176. In an embodiment, mounting slot 179 is round while mounting slot 176 is oblong, to distinguish between the connectors toward the front and back respectively. In an embodiment, connectors 178 and 175 also include hardware for attaching these connectors to the armrest module 170.

FIG. 7A is a perspective view of the inner edge of a left armrest module 172, with close-up end views of left armrest back connector 180, according to an embodiment. The left armrest module incorporates a back connector 180 having a configuration corresponding to the seat back connector 164 shown in FIG. 4A. Components of armrest back connector 180 include a lever clip assembly 183 pivotally mounted at pivot 184. The lever clip assembly includes an arcuate channel 185 that guides pivoting motion of lever clip assembly between a closed position, shown in FIG. 7A, and an open position when a user flips lever 136, in order to secure the connection of the left armrest to left seating module 110. Additional aspects of the structure and operation of back armrest connector 180 are described above with reference to the seat back connector 164 of FIG. 4A.

FIG. 7B is a perspective view of the inner edge of a right armrest module 174, with close-up end views of right armrest back connector 188, according to an embodiment. The left armrest module incorporates a back connector 188 having a configuration corresponding to the seat back connector 162 shown in FIG. 4B. Armrest back connector 188 includes a dowel pin 190 protruding from plate 189, which mates with a mounting slot of the right back connector of right seating module 118 as one of the dowel pin joints between modules 118 and 174.

It should be understood that in modular sofa embodiments incorporating dowel pin (pin and slot) connectors, the modular sofa may utilize other pin and slot configurations than shown in FIGS. 4A-7B. Additionally, the modular sofa may incorporate other mechanisms for securing connections between modules. For example, the embodiment of FIGS. 13-16 incorporates a different configuration of pins and slots for unsecured connections between modules. As another example, the embodiment of FIG. 17 incorporates threaded fasteners in lieu of latch-catch mechanisms to secure the lower (seat section) connections between modules.

Figure 13:
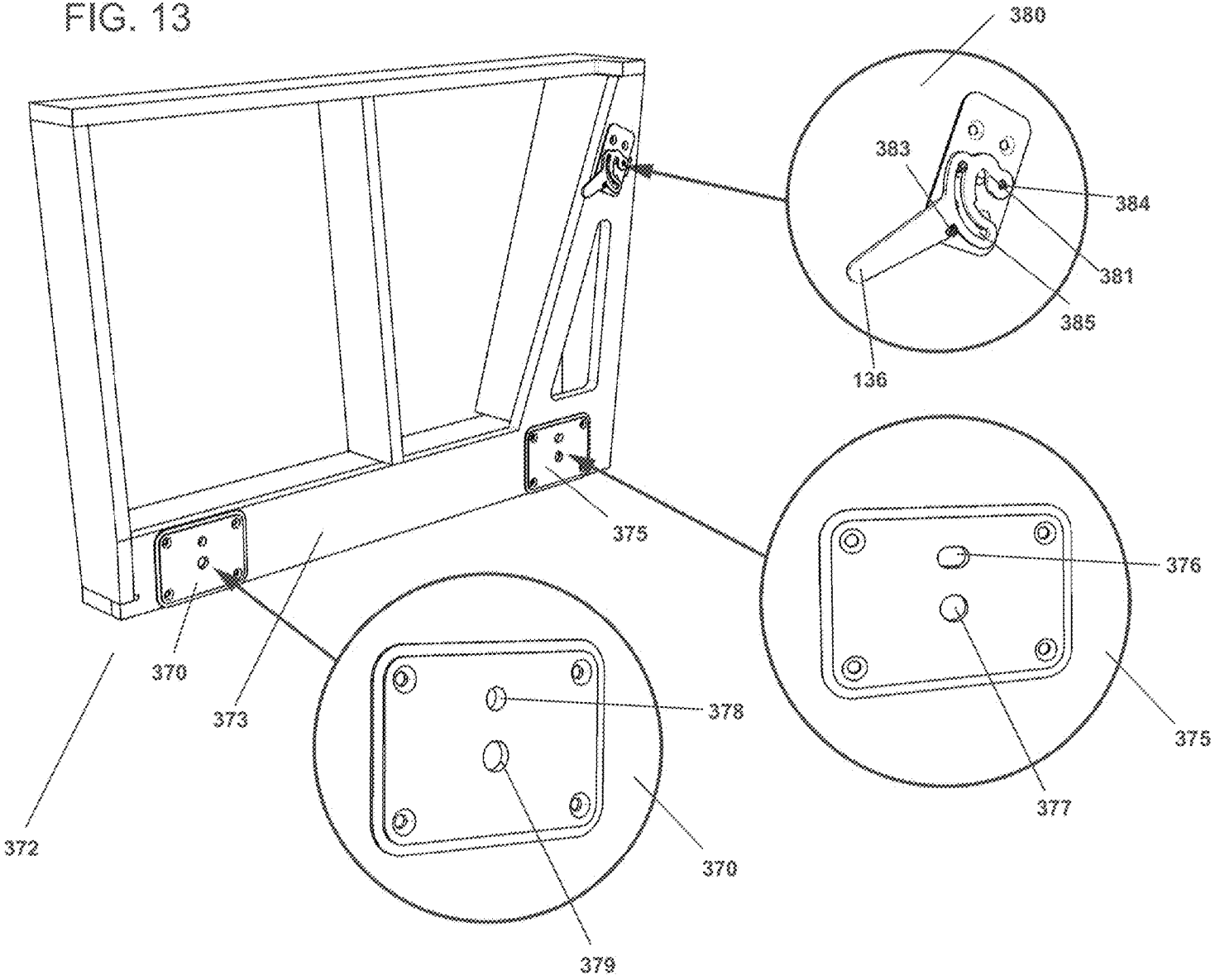
FIG. 13 is a perspective view of the inner edge of a left armrest module, with close-up end view of left armrest back connector, according to a further embodiment.
Figure 14:
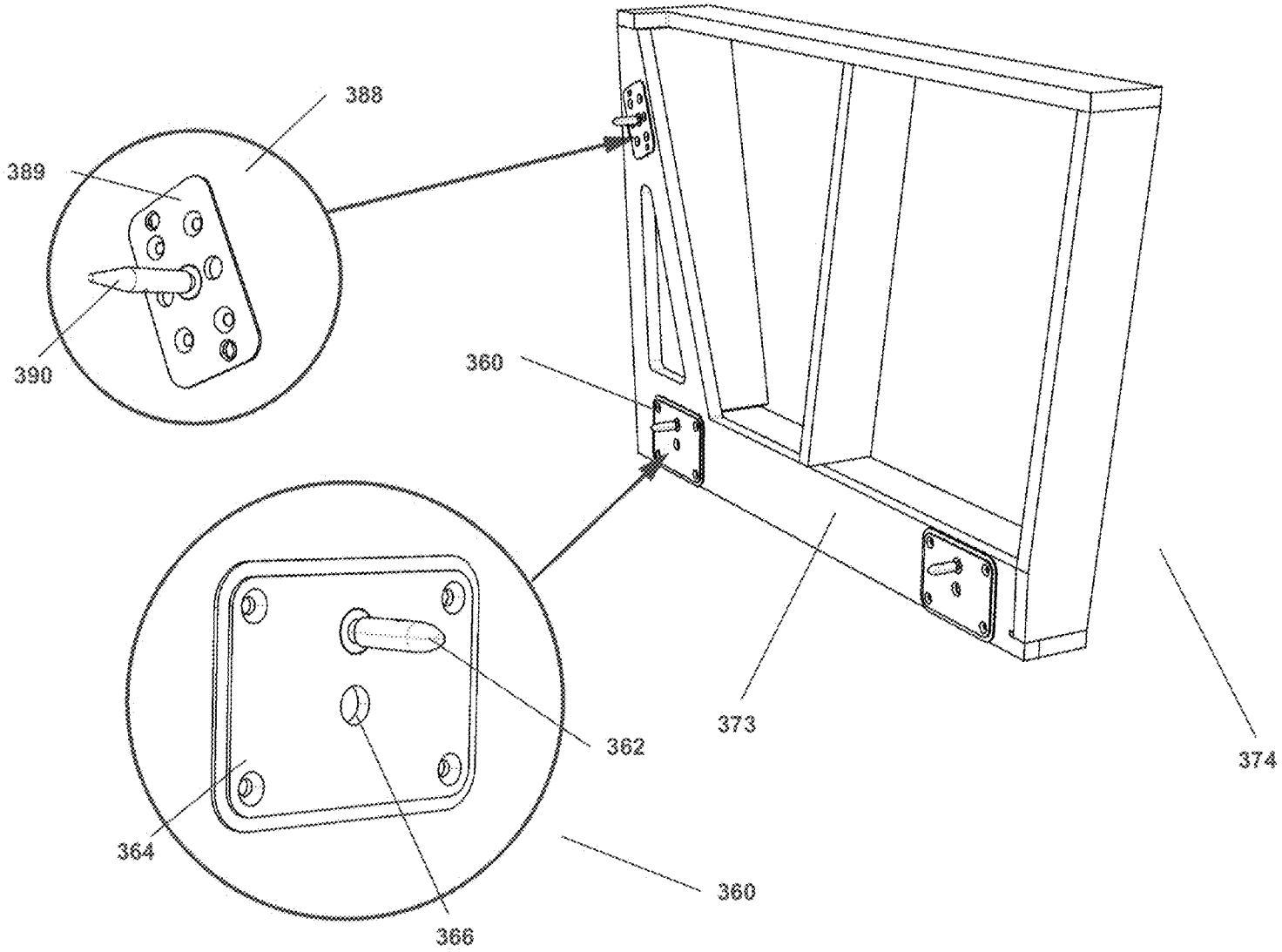
FIG. 14 is a perspective view of the inner edge of a right armrest module, with close-up end view of right armrest back connector, according to the embodiment of FIGS. 13-17.
Figure 15:
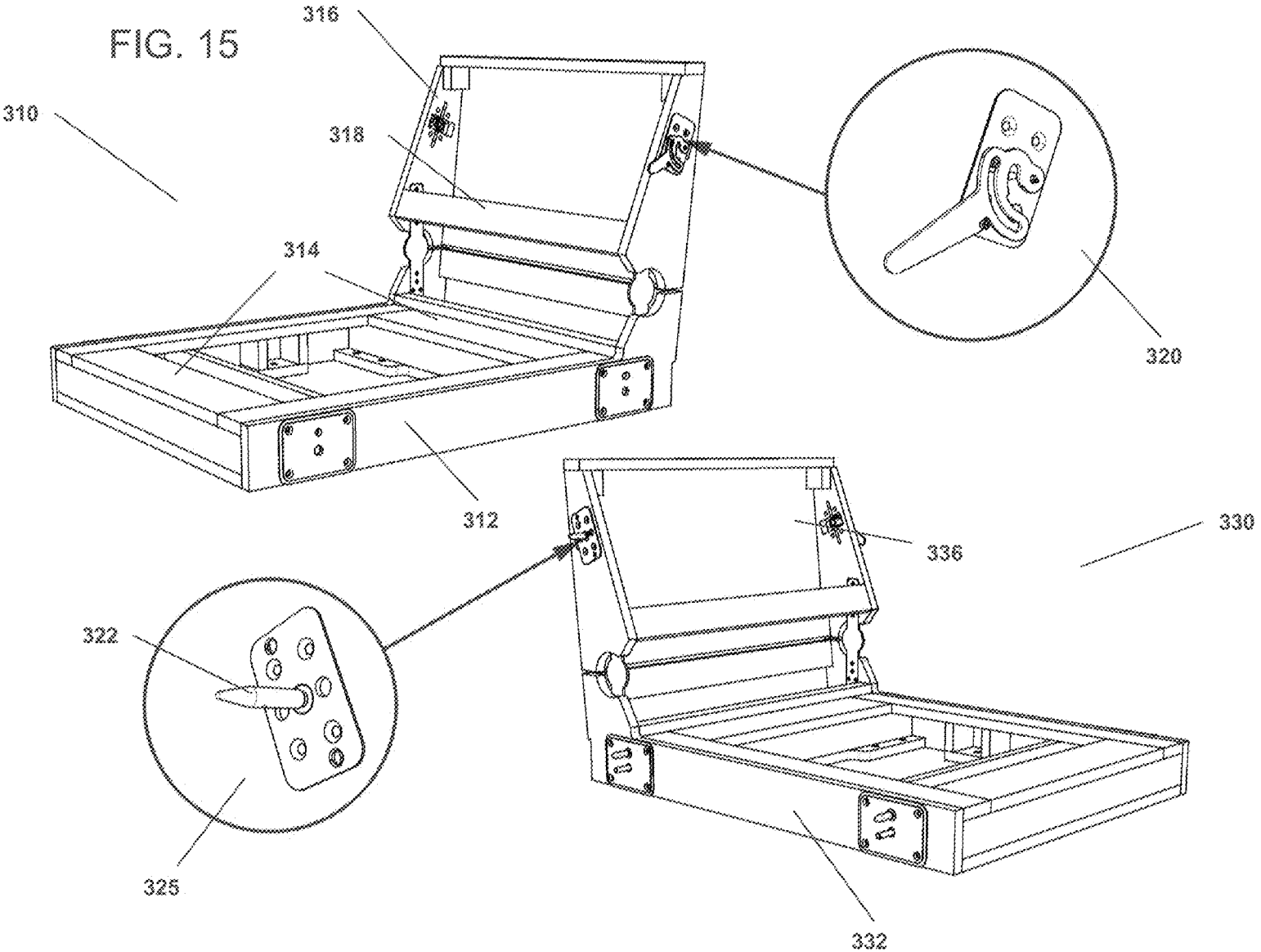
FIG. 15 shows perspective views of the left inner edge and the right inner edge of a seating module with surface fabric removed, respectively with close-up end views of left back connectors and right back connectors, according to the embodiment of FIGS. 13-17.
Figure 16:
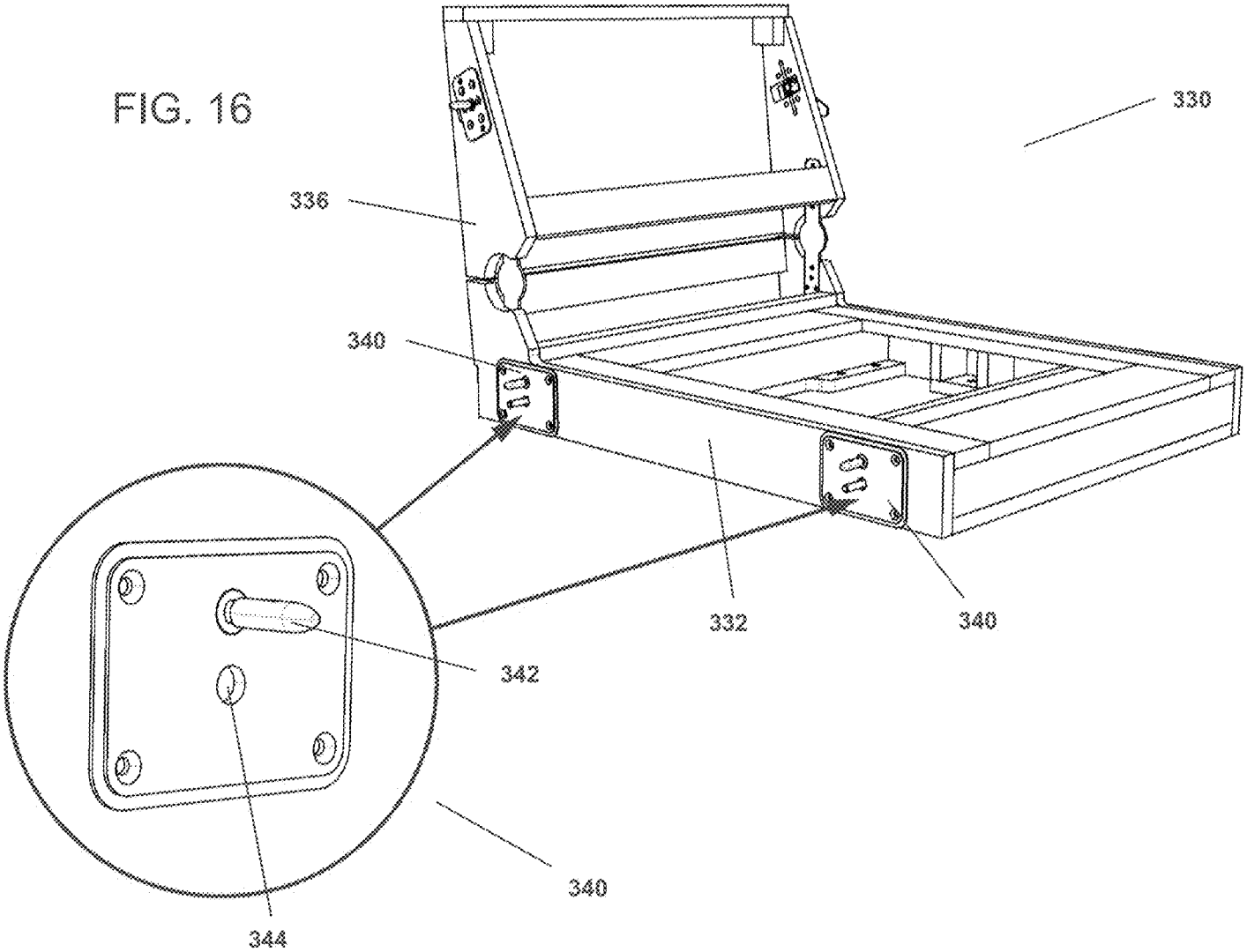
FIG. 16 is a perspective view of the left inner edge of a seating module with surface fabric removed, with a close-up end views of left seat connectors, according to the embodiment of FIGS. 13-17.

A further modular sofa embodiment shown in FIGS. 13-17 incorporates a different design of seating connectors, and different layout of pins and slots than the embodiment of FIGS. 4A-7B. FIG. 13 is a perspective view of the inner edge of a left armrest module 372. The left armrest module incorporates a back connector 380 having a configuration corresponding to the seat back connector 164 shown in FIG. 4A. Components of armrest back connector 380 include a lever clip assembly 383 pivotally mounted at pivot 384. The lever clip assembly includes an arcuate channel 385 that guides pivoting motion of lever clip assembly between a closed position, shown in FIG. 13, and an open position when a user flips lever 136, in order to secure the connection of the left armrest to a seating module such as seating module 330 (FIG. 16). Additional aspects of the structure and operation of back armrest connector 380 are described above with reference to the seat back connector 164 of FIG. 4A.

The left armrest module 372 further includes a front armrest seat connector 370, and rear armrest seat connector 375. These slotted armrest seat connectors both have a dual-slot configuration as contrasted to the single-slot configuration of slotted connectors in the embodiment of FIGS.

4A-7B. Each of connectors 370, 375 incorporates an upper slot used in unsecured connection of adjacent modules, and a lower slot used in securing these connections. Thus, front connector 370 includes a round upper slot 378 for unsecured dowel pin connection, and rear connector 375 includes an oblong upper slot 376 for unsecured dowel pin connection, slot 376 being visually distinct from slot 378 to distinguish front vs. back connectors. Front connector 370 also includes a lower slot 379, and rear connector 375 includes a lower slot 377, each of which forms part of a securement mechanism. For example, the lower slots may form part of the threaded fastener assemblies shown in FIG. 18.

FIG. 14 is a perspective view of the inner edge of a right armrest module 374. The left armrest module incorporates a back connector 388 having a configuration corresponding to the seat back connector 162 shown in FIG. 4B. Armrest back connector 388 includes a dowel pin 390 protruding from plate 389, which mates with a mounting slot of the right back connector of seating module 310 (FIG. 15) as one of the dowel pin joints between modules 310 and 374. The armrest seat connector 360 incorporates an upper dowel pin 362, and a lower slot 366. Dowel pin 390 forms a pin-and-slot unsecured connection with an upper slot of a seating connector of an adjacent seating module (e.g., slot 352 in connector 350 of seating module 310, FIG. 17), while lower slot 366 serves as part of a securement mechanism, such as the threaded fastener securement shown in FIG. 18.

FIG. 15 shows perspective views of the left inner edge and the right inner edge of a seating module with surface fabric removed, respectively with close-up end views of left seat connectors and right seat connectors. As viewed from the right edge, the seating module 310 includes a back connector 320 which may have the same configuration as the armrest back connector 380 described above in the discussion of FIG. 13. As viewed from the left edge, the seating module 330 includes a back connector 325 which may have the same configuration as the armrest back connector 390 described above in the discussion of FIG. 14.

In one embodiment, each of the seating modules and armrest modules is formed of a frame made from a suitable structural material such as soft or hard woods, chipboard, medium-density fiberboard, oriented strand board or plywood. The frame is in turn upholstered at required locations in fabric, leather, lining cloth, inter-liner, or other appropriate material, or combinations of materials. References in the present disclosure to structures of the modular sofa such as seating modules and armrest modules, and to portions of these structures such as surfaces, may refer to various materials including, e.g., frame and upholstering. For example, the seating module 310 of FIG. 15 is shown with surface material (e.g., upholstering such as fabric) removed to expose interior structures of the seat section 312 and interior components of the backrest section 316. These interior structures include frame members 314 extending across seat section 312, and frame member 318 extending across backrest section 316.

FIG. 16 is a perspective view of the left inner edge of a seating module 330 with surface fabric removed. Seating module 330 includes at its left inner edge identical front and rear seat connectors 340. Each of these connectors includes an upper dowel pin 342 and a lower slot 344. Dowel pin 342 forms a pin-and-slot unsecured connection with an upper slot of an adjacent module (e.g., slot 352 in connector 350 of seating module 310, FIG. 17), while lower slot 344 serves as part of a securement mechanism, such as the threaded fastener securement shown in FIG. 18.

Figure 17:
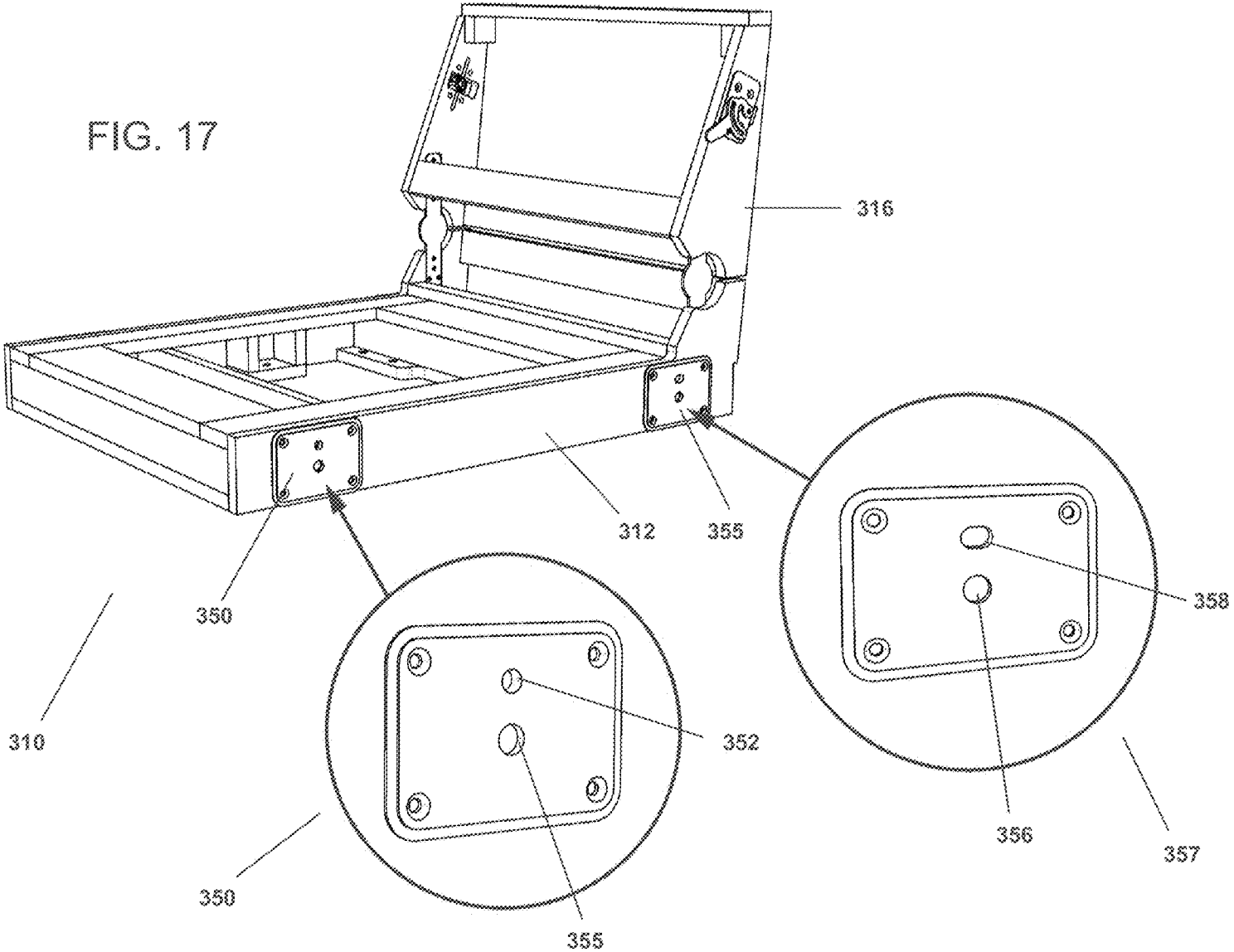
FIG. 17 is a perspective view of the right inner edge of a seating module with surface fabric removed, with close-up end views of right seat connectors, according to the embodiment of FIGS. 13-17.

FIG. 17 is a perspective view of the right inner edge of a seating module 310 with close-up end views of right seat connectors. Seating module 310 includes at its left inner edge identical front seat connector 350 and rear seat connector 355, which may have the same dual-slot configurations as the armrest-seat connectors 370, 375 shown in FIG. 13. Front connector 350 includes a round upper slot 352 for unsecured dowel pin connection, and rear connector 355 includes an oblong upper slot 358 for unsecured dowel pin connection. Front connector 350 includes a lower slot 355, and rear connector 355 includes a lower slot 356, as part of a securement mechanism. For example, the lower slots may accommodate the threaded fastener securement mechanism shown in FIG. 18.

Figure 18:
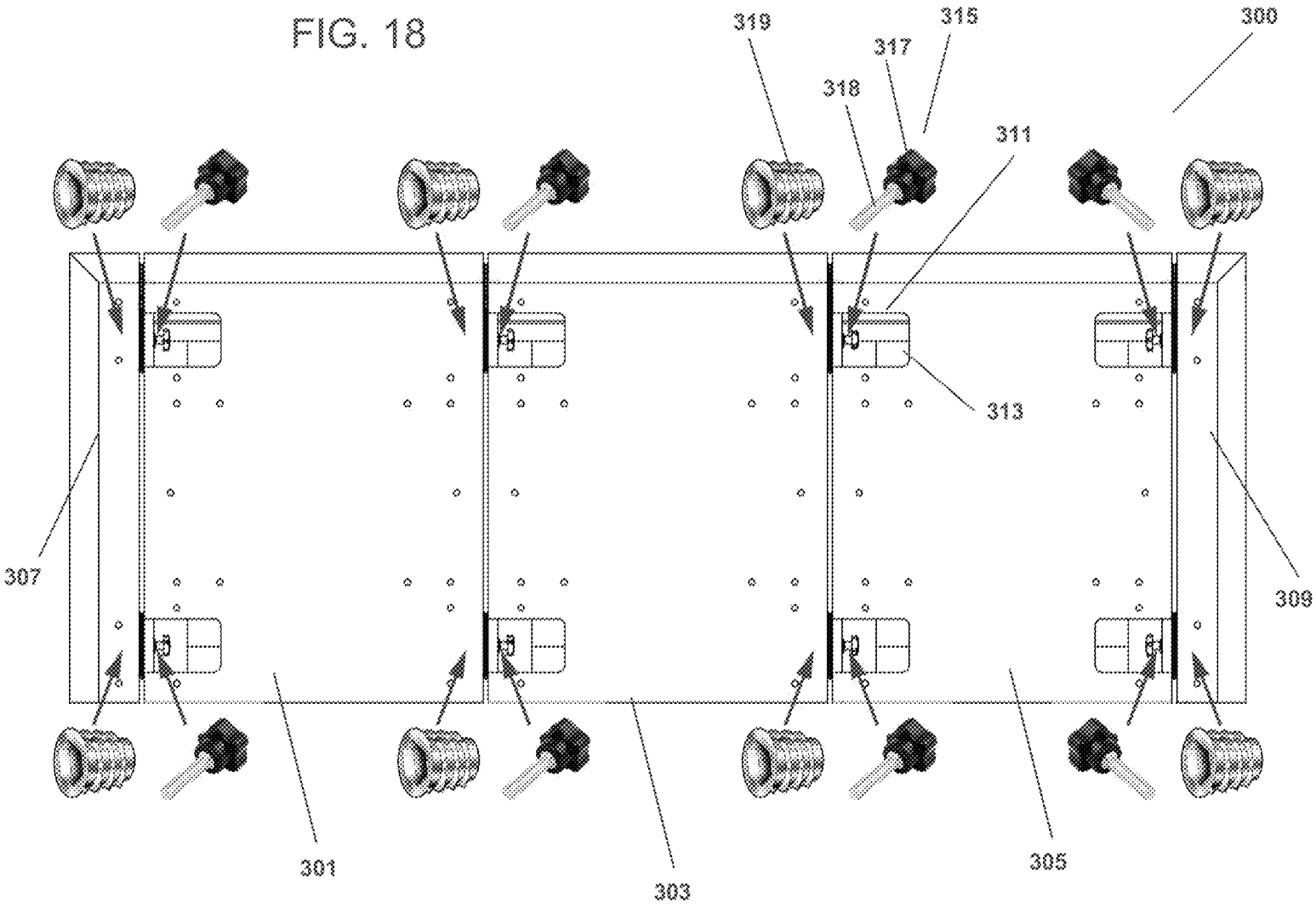
FIG. 18 is a schematic bottom view of a modular sofa with three seating modules and two armrest modules, with close up views of associated fasteners for securing connections between modules, according to an embodiment.

FIG. 18 illustrates a further embodiment of assembled modular sofa 300 as viewed from the bottom, showing components of a mechanism for securing connections between adjacent modules. Sofa 300 includes left seating module 301, middle seating module 303, and right seating module 305, as well as left armrest module 307 and right armrest module 309. Seating modules 301, 303, and 305 each include recessed connectors 313 at front and back locations on their left edges, and right seating module 305 also includes recessed connectors 313 at front and back locations at its right edge. Connector assemblies 313 include a mechanism for unsecured connection of the modules (such as dowel pin mechanism, not seen in this view), as well as fastener assemblies to secure these connections. An example of the securement mechanism is the back connector between modules 303 and 305, which includes a threaded fastener 315. Threaded fastener 315 incorporates a bolt or threaded shaft 318, and a hand-held knob 317. The threaded shaft 318 can be rotatably inserted into an inner threaded surface of threaded insert 319 seen on the left in FIG. 18. For example, two threaded inserts 319 may be embedded in seating module 310 behind apertures 355, 356 of the connectors 350, 357 (FIG. 17). The user secures the connections between adjacent, abutting modules by screwing the threaded fasteners 315 into the lower, securement slots of the slotted connectors by turning hand-held knobs 317.

Figure 8:
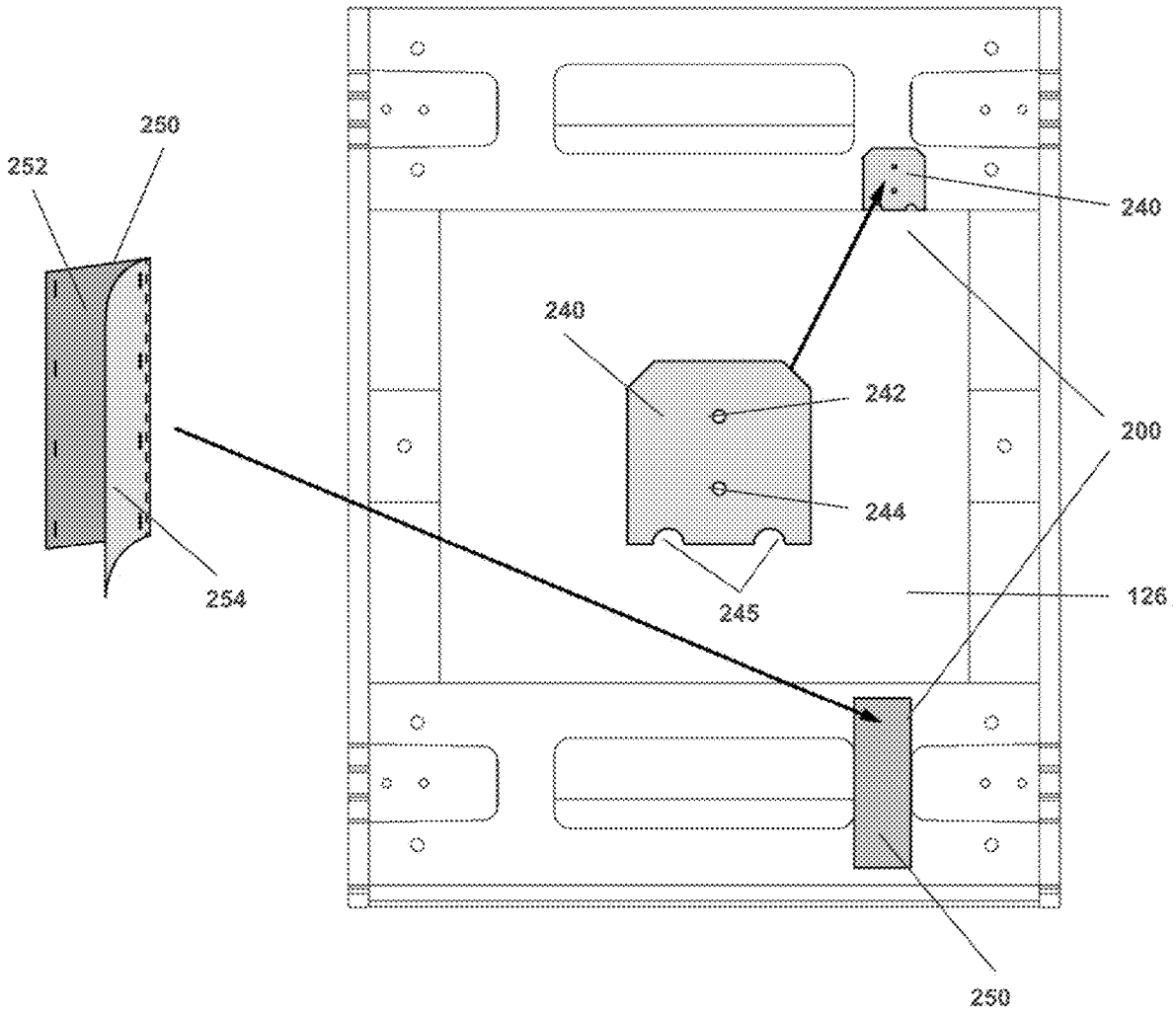
FIG. 8 is a bottom plan view of seating module with power cradle mounting mechanisms, according to an embodiment.
Figure 9:
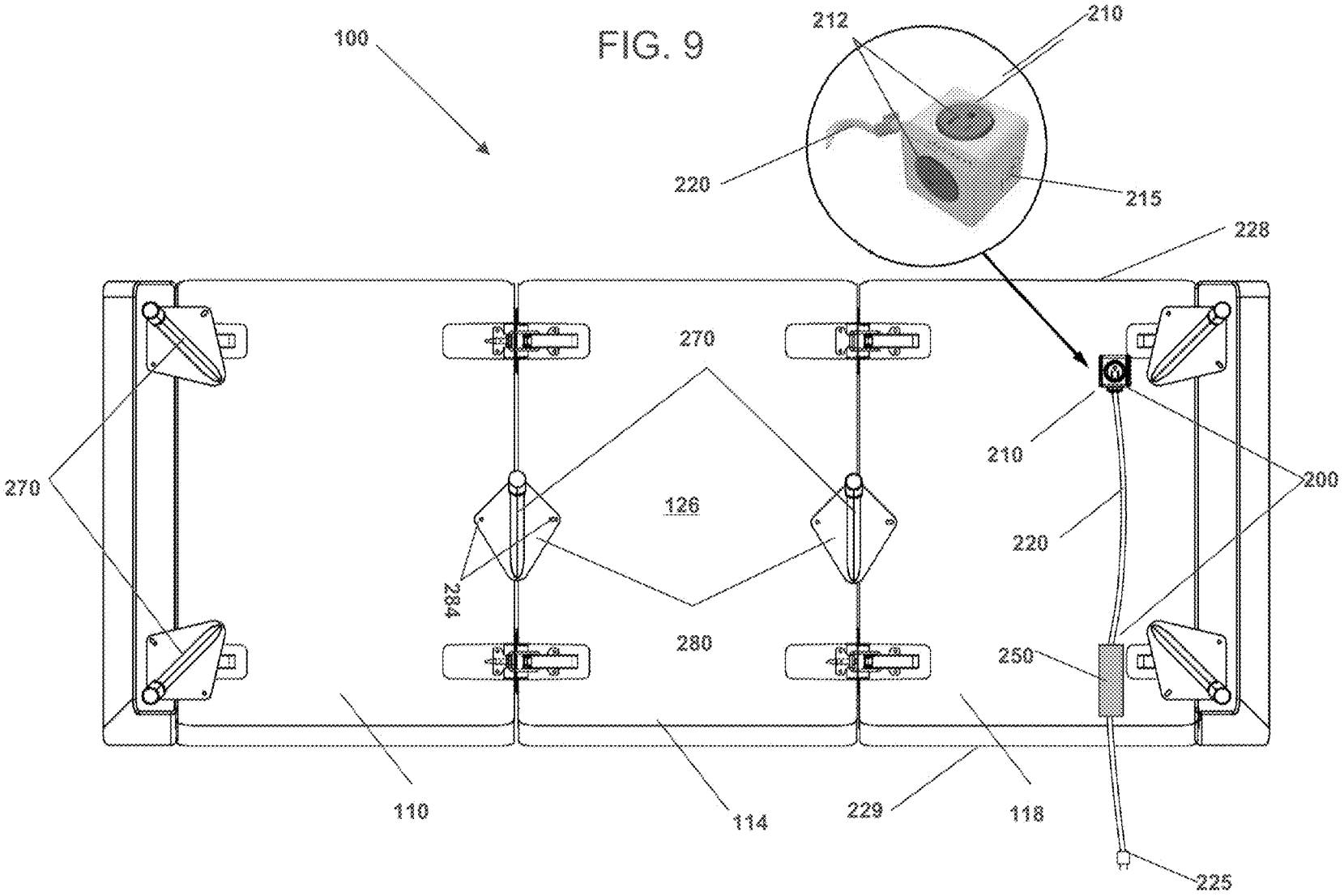
FIG. 9 is a bottom plan view of assembled sofa with power cradle, according to an embodiment.

FIG. 8 is a bottom plan view of a seating module with mounting mechanisms for a power cradle 200, according to an embodiment. A mounting plate 240 is located toward the front edge of the bottom surface 126 of the seating module, for mounting a power outlet member (FIG. 9). In an embodiment, the mounting member is a mounting plate for a cubic power adaptor 210, and has a square shape with indentations 245 that indicate the proper mounting orientation of the mounting plate. The mounting plate may include a pressure sensitive adhesive backing (not shown) for adhesion to bottom surface 126. In an embodiment, mounting plate includes mounting apertures 242, 244 that mate with pins (not shown) of the cubic power adaptor.

FIG. 8 also shows a fastening strip 250 for mounting an AC power cable 220 (FIG. 9) to bottom surface 126. In an embodiment, fastening strip includes a base strip 252 and a cover strip 254. In an embodiment, fastening strip 250 incorporates a hook-and-loop mechanical fastening system, such as Velcro® hook and loop lineal fabric strips (Velcro is a registered trademark of Velcro S.A. Corporation, Lenzerheide, Grisons Switzerland).

FIG. 9 shows a bottom plan view of assembled sofa with a mounted power cradle assembly, according to an embodiment. The power cradle 200 includes a cubic power adaptor 210 mounted adjacent the front edge 228 of the bottom surface 126 of modular sofa. The power adaptor 210 may be positioned adjacent the front edge if it is accessible to a user to plug a device into one or more of the outlets 212, 215 from the front of the modular sofa 100. As seen in the enlarged perspective view, cubic power adaptor 210 includes multiple AC power outlets 212, here shown on two faces of the power adaptor, and a charging port 215 on a third face of the power adaptor. An AC power cord extends from cubic power adaptor 210 externally of the bottom surface 126. In various embodiments, cubic power adaptor 210 is a multiple electrical socket adaptor manufactured by the Allocacoc Corporation, Shanghai, China. In one embodiment as shown in the enlarged perspective view of power adaptor 210, the power adaptor is an Extended USB model Allocacoc PowerCube' Electric Outlet Adapter. This power adaptor model includes four AC power socket outlets 212, a dual USB port 215, and a 5 ft. extension cord 220. As illustrated, the AC power socket outlets are three prong AC socket outlets in accordance with the North American standard of 120 volts at 60 Hz. Alternatively, AC power outlets may embody the European standard of 220-240 volts at 50 Hz., or other international standards. Plugs and socket outlets according to various standards are described in IEC technical report TR 60083, Plugs and socket-outlets for domestic and similar general use standardized in member countries of IEC, of the International Electrotechnical Commission. In various embodiments charging port 215 is a dedicated USB port such as Lighting, Micro USB, and Mini USB, according to Universal Serial Bus industry specifications such as USB 1.0, 2.0, 3.0, 3, and USB-C.

AC power cable 220 extends from cubic power adaptor 210 to and beyond the back edge 229 of the bottom surface 126 of modular sofa 100. AC power cord 220 terminates at a power plug, e.g., a three prong AC plug in accordance with the North American standard, which may be plugged into a power outlet located behind modular sofa 100.

Figure 10:
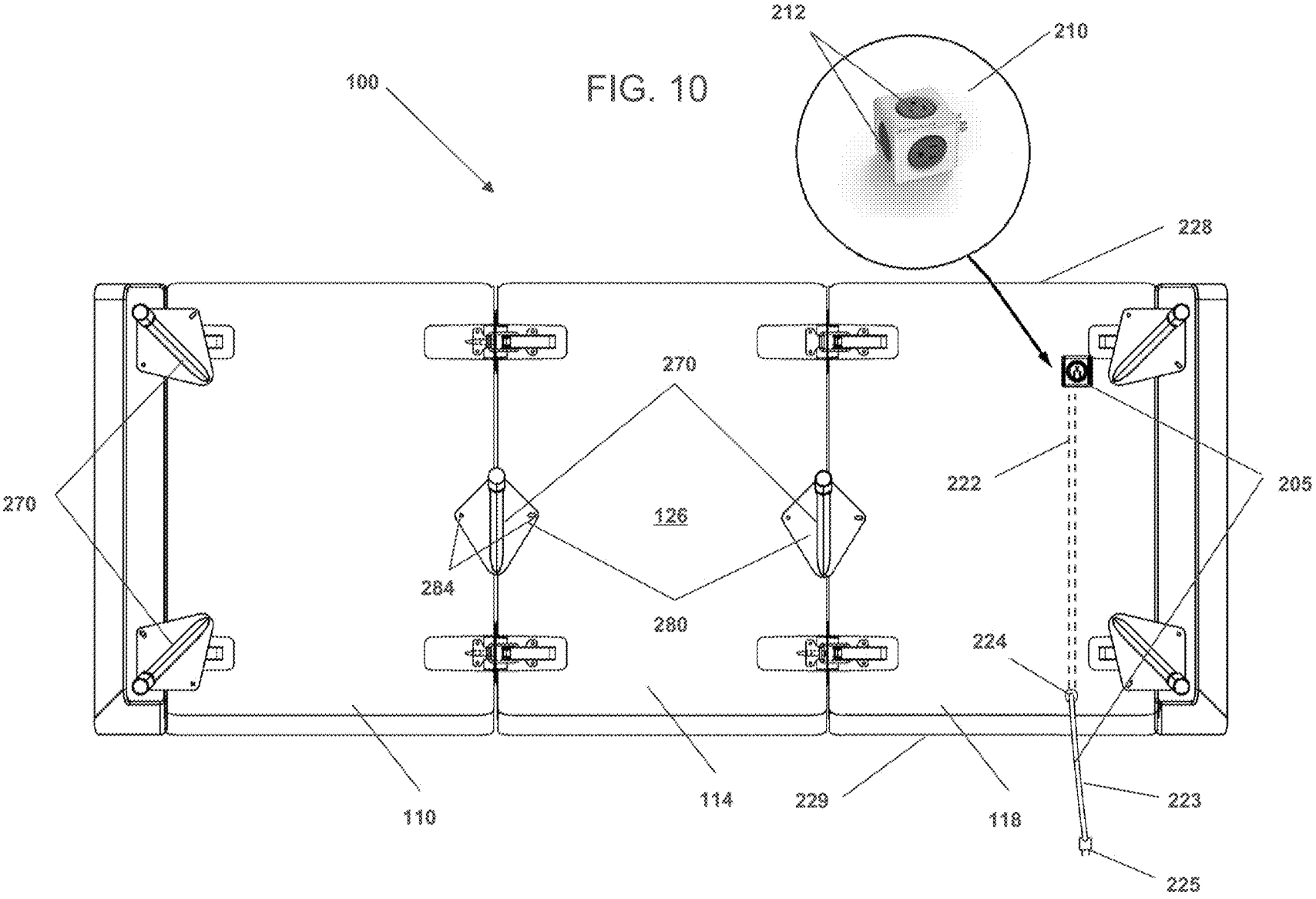
FIG. 10 is a bottom plan view of assembled sofa with power cradle, according to an embodiment.

FIG. 10 shows a bottom plan view of assembled sofa with a mounted power cradle assembly, according to a further embodiment. The power cradle 200 includes a cubic power adaptor 210 mounted adjacent the front edge 228 of the bottom surface 126 of modular sofa. In one embodiment as shown in the enlarged perspective view of power adaptor 210, the power adaptor is an Allocacoc PowerCube Original Electric Outlet Adapter manufactured by the Allocacoc Corporation, Shanghai, China. This power adaptor model includes four AC power socket outlets 212 and a dual USB port 215. In this embodiment, a first segment 222 of AC power cable 220 extends internally relative to the bottom surface 126 from a mounting location for power adaptor 220, to an aperture 224 in the bottom surface 126 near the rear edge 229. A second segment 223 of power cable 220 extends from aperture 224 to and beyond the back edge 229 of the bottom surface 126 of modular sofa 100. AC power cord 220 terminates at a power plug, e.g., a three prong AC plug in accordance with the North American standard, which may be plugged into a power outlet located behind modular sofa 100.

In the embodiments of FIGS. 9 and 10, power cradle 220 is located at the bottom surface of the right seating module 118 of three seating modules 110, 114, 118. In other embodiments, power cradle 220 is located at the bottom surface of a seating module other than the right seating module. Multiple power cradles 220 may also be located at bottom surfaces of multiple seating modules. In further embodiments, bottom mounted power cradle 220 can be deployed at a bottom surface of other types of modular sofa, as well as non-modular sofa.

Some or all elements of power cradle 200 may be pre-assembled to the bottom surface 126 of a seating module as that module is shipped, and some or all elements of power cradle 200 may be assembled by user to the bottom surface during the assembly of modular sofa 100. For example, a mounting dock 240 may be pre-assembled to the bottom surface and/or one or more fastening strip 250 may be pre-assembled to the bottom surface, as shown in FIG. 8 and in FIGS. 11, 12. In another example, a power cable may be pre-assembled with a section of the cable internal to the bottom surface, as shown in FIG. 110.

Figure 11:
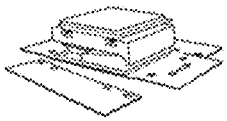
FIG. 11 is a schematic diagram of first through sixth steps of a sofa installation procedure, according to an embodiment.
Figure 11:
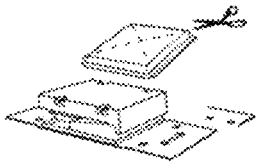
Figure 11:
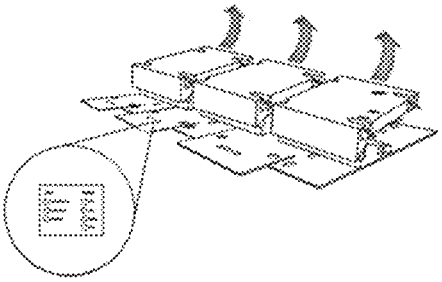
Figure 11:
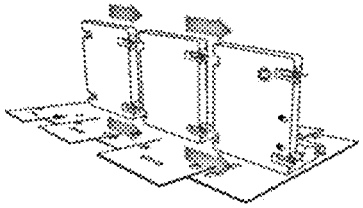
Figure 11:
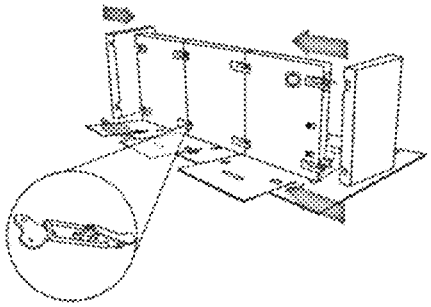
Figure 11:
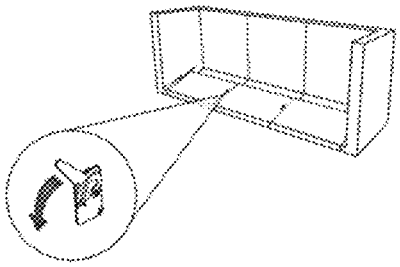
Figure 12:
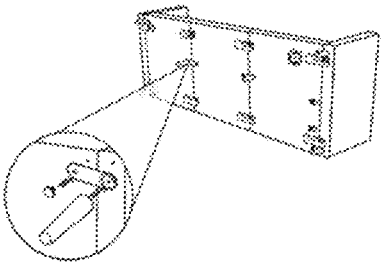
FIG. 12 is a schematic diagram of seventh through twelfth steps of a sofa installation procedure, according to the embodiment of FIG. 11.
Figure 12:
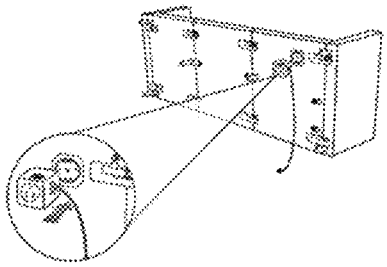
Figure 12:
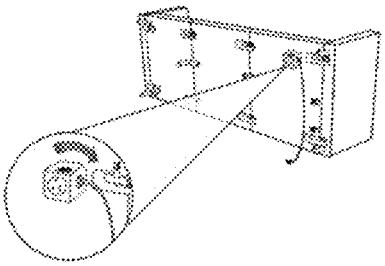
Figure 12:
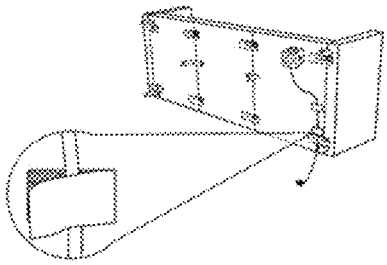
Figure 12:
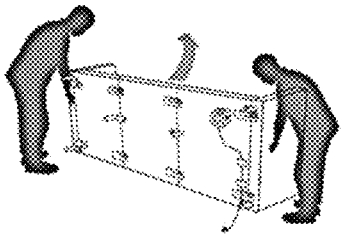
Figure 12:
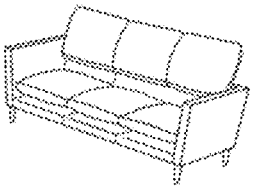

FIGS. 11, 12 shows an exemplary process (including steps 1-6 numbered in FIG. 11, and steps 7-12 numbered in FIG. 12) for unpacking and assembling a modular sofa according to a further embodiment. At step 1 the user tears off a perforated flap of packaging containing a seating module and cushions for that seating module. At step 2 the user removes the cushions, cutting open their vacuum seals to remove the cushions from vacuum packaging. At step 3, the user aligns seating modules 110, 114, 118 from left to middle to right, then flips open the modules as described for FIG. 1C.

At step 4, the user aligns the pins and mating slots of adjacent modules, then slides the modules together. In an embodiment, middle module 114 is slid into abutting engagement with right module 118, then left module 110 is slid into abutting engagement with middle module 114. At step 5, the user aligns the armrests with the seating modules, and slides the armrests into abutting engagement with the adjacent seating modules. Then, the user secures all eight latches (or other securement device; e.g., threaded fasteners as in FIG. 17) of the connections between modules at the sofa bottom. At step 6, the user accesses the other (upper) side of the sofa standing on its back, and rotates the levers to secure the backrest connections. The user rotates the levers down until the user feels a click.

At step 7 (FIG. 12), the user mounts legs to the bottom surface of modular sofa 100, using thumbscrews and plastic mounting plates. In an embodiment, the legs have threaded shafts to screw into the sofa bottom 126, and these mounting steps require no tools. At step 8, the user aligns the cubic power adaptor with a mounting dock that is pre-assembled to the right seating module. The user attaches the power adaptor to the mounting dock with its integrated power cable facing to the right. Then, at step 9 the user rotates the power adaptor cube clockwise to lock it into place on the mounting dock.

At step 10, the user secures the power cord to the sofa bottom using two fastening strips that are pre-assembled to the sofa bottom at two locations between the mounting dock and the rear edge of the seating module. In an embodiment, these power strips are Velcro® hook and loop lineal fabric strips. At step 11, the user reorients the modular sofa in its upright, use orientation, and at step 12 the user arranges cushions on the sofa seat and backrest.

In further embodiments, the modular sofa of the present disclosure can be assembled with one or more other types of modules besides sofa seating modules and sofa armrest modules to form a combination sofa that includes other furniture, including a shelf, refrigerator, table, or the like. For example, one edge surface of a seating module can include connectors in accordance with the present disclosure that join with connectors at an abutting edge surface of an end table module. Additionally, the modular components of the present disclosure can incorporate a corner seating module that includes seating connectors at adjacent first and second edge surfaces of the corner seating module. In this embodiment, the corner seating module would be connected to one or more seating module at the first edge surface of the corner seating module, and to one or more seating module at the second edge surface of the corner seating module, thereby forming a corner sectional sofa.

Figure 19:
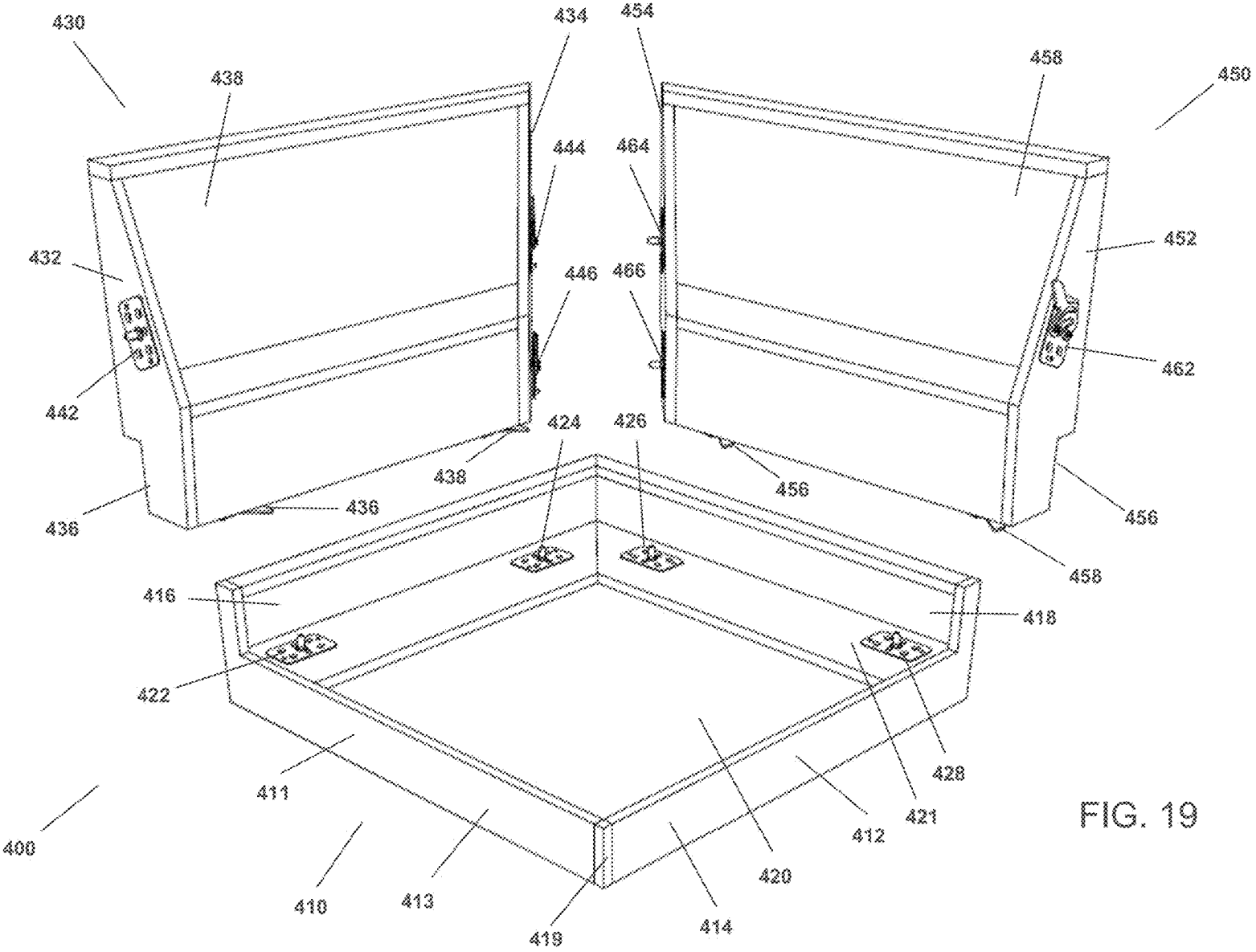
FIG. 19 is an disassembled view of a corner module, according to an embodiment.

FIG. 19 shows a corner module that can be incorporated in a corner sectional (also herein called a corner sectional sofa) and other modular furniture. In the present disclosure the corner module is also called a corner seating module, corner section or simply a corner. A corner sectional assembly including the corner seating module may also incorporate the seating modules and armrest modules of the present disclosure. As with the seating modules and armrest modules, various components of the corner module as well as ancillary components such as legs and cushions may be shipped in separate containers, or may efficiently be combined in a container. Like the seating module and armrest module, the corner module is designed to be shipped in a compact configuration of moderate weight for ease of transportation and handling. Upon reaching the premises at which a corner sectional assembly is to be installed, these modules can be moved within the premises without damage, facilitating placement of a corner sectional assembly in locations that may not be easily accessible to conventional corner sectionals. Furthermore, the corner module's modular construction, as well as corner sectionals including this module, are suitable for assembly without special tools or training.

The corner module 400 of FIG. 19 facilitates assembly with other modules of the present modular furniture (e.g., seating modules) by using the same or similar connectors or clips for engaging the corner module with adjacent modules. Similar to seating modules and armrest modules, corner module 400 include side edge surfaces 412, 432, 452, substantially planar surfaces configured for side-by-side abutting engagement when adjacent modules are assembled and secured to each other. In contrast to side edge surfaces of seating modules and armrest modules that face to the left or to the right when the modules are in their normal use configurations in modular furniture, side edge surfaces 432, 452 of corner module 400 face in transverse directions (e.g., perpendicular directions) to form a corner configuration when assembled with adjacent furniture modules.

The exploded view of FIG. 19 shows major structural components of a corner module 400, including a corner base 410, a first corner back 430, and a second corner back 450. Unlike the seating modules of the present disclosure that include a seat section and backrest section as integral components that may be shipped together while in a compact folded configuration, the corner base 410 and corner backs 430, 450 are separate components until assembled. In an exemplary embodiment, corner base 410 is shipped in one box (e.g., with seat cushion), and corner backs 430, 450 are shipped together in another box (e.g., with backrest cushions).

Corner base 400 includes a lower horizontal surface 420 and a plurality of edge walls extending upwardly from lower horizontal surface 420. In an embodiment, corner base 400 defines a substantially polygonal horizontal shape including four or more side edges, such as a square, rectangle or rhombus. In various embodiments, the plurality of edge walls include first and second edge walls 413, 414 located at a front portion of corner base 400, and third and fourth edge walls 416, 418 located at a rear portion of corner base 400. In an embodiment, first edge wall 413 and second edge wall 415 are low profile members that define outer side edge surfaces 411, 412 adjoining a front corner 419 of the substantially polygonal horizontal shape. In an embodiment, side edge surfaces 411, 412 are oriented perpendicularly to each other, and the substantially polygonal horizontal shape is substantially square. In an embodiment, third edge wall 416 and fourth edge wall 418 are more prominent than first and second edge walls 413, 414, and include guide surfaces for engaging corner backs 430, 450. In an embodiment, third and fourth edge walls 413, 414 guide and engage the corner backs during assembly, and support the corner backs 430, 450 in the assembled corner base 410. In an embodiment, the lower horizontal surface 420 carries base connectors 422, 424, 426, 428. In an embodiment, the base connectors are located at a rear portion of the lower horizontal surface adjacent edge walls 416 and 418, and the base connectors and edge walls act together to securely engage and support the corner backs 430, 450 in the assembled corner module. In an embodiment, base connectors 422, 424, 426, 428 are located at an elevated section 421 of lower horizontal surface 420.

First corner back 430 and second corner back 450 are vertically extending members configured to provide backrest surfaces. The corner backs 430, 450 are also called corner backrest sections in the present disclosure. First corner back 430 includes a backrest surface 438, outer side edge surface 432, and inner side edge surface 434. Similarly, second corner back 450 includes a backrest surface 458, outer side edge surface 452, and inner side edge surface 454. First corner back 430 includes a mounting portion 436 at a lower region of the first corner back, and second corner back 450 includes a mounting portion 456 at a lower region of the second corner back. In an embodiment, mounting portion 436 and mounting portion 456 are indented surfaces of the first and second corner backs. During assembly of the corner module, mounting portions 436, 456 are configured to engage third and fourth edge walls 416, 418 of base 410 during assembly and form an engineering fit with edge walls 416, 418 to firmly secure first corner back 430 and second corner back 450 to corner base 410.

First corner back 430 includes at its bottom edge connectors 436, 438 that are configured respectively to engage connectors 422, 424 when corner back 430 is lowered into mating alignment with corner base 410. Second corner back 450 includes at its bottom edge connectors 456, 458 that are configured respectively to engage connectors 426, 428 when corner back 450 is lowered into mating alignment with corner base 410. In an embodiment, these respective connectors form dowel joints that provide releasable connections of the corner backs to the corner base. In an embodiment, the connectors at corner base include dowel pins, while the connectors at corner backs 430, 450 include slots (not visible in FIG. 19).

Figure 22A:
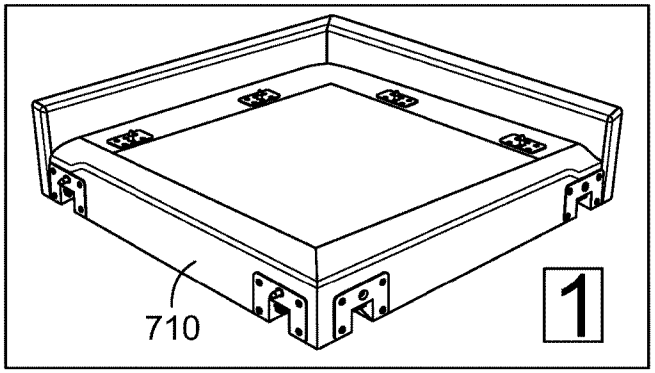
FIG. 22A is a perspective view of a first step of a second phase of a corner sectional assembly procedure, according to the embodiment of FIGS. 22A-22H.
Figure 22B:
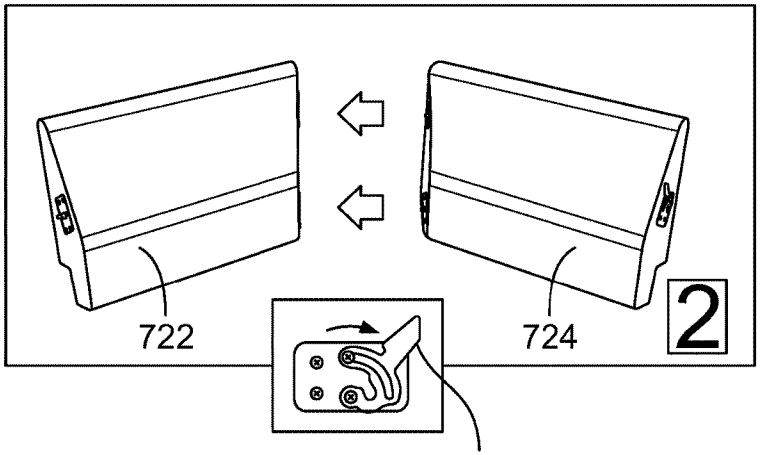
FIG. 22B is a perspective view of a second step of a second phase of a corner sectional assembly procedure, according to the embodiment of FIGS. 22A-22H
Figure 22C:
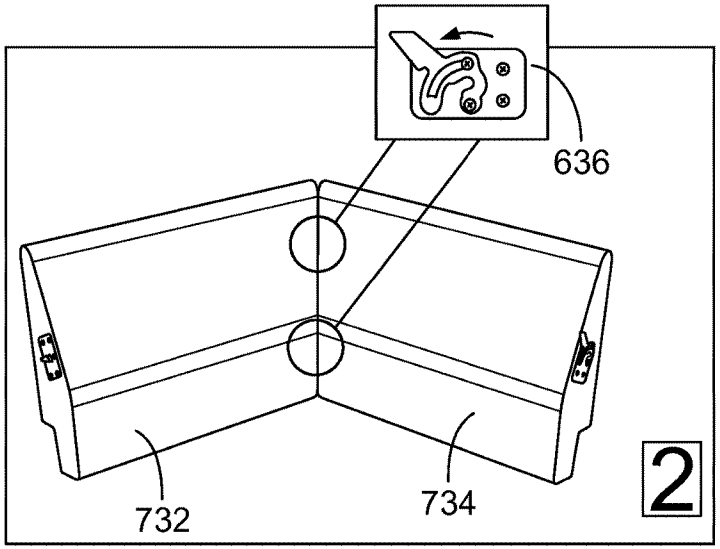
FIG. 22C is a further perspective view of a second step of a second phase of a corner sectional assembly procedure, according to the embodiment of FIGS. 22A-22H
Figure 22D:
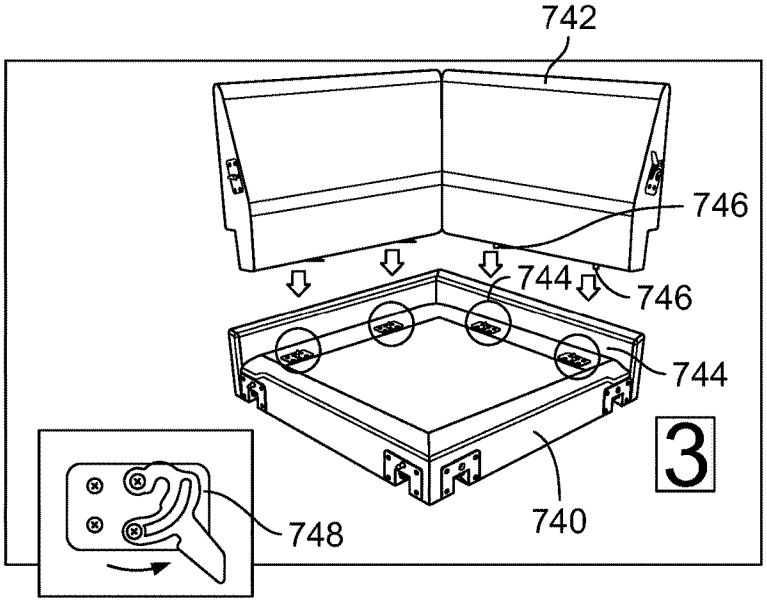
FIG. 22D is a perspective view of a third step of a second phase of a corner sectional assembly procedure, according to the embodiment of FIGS. 22A-22H
Figure 22F:
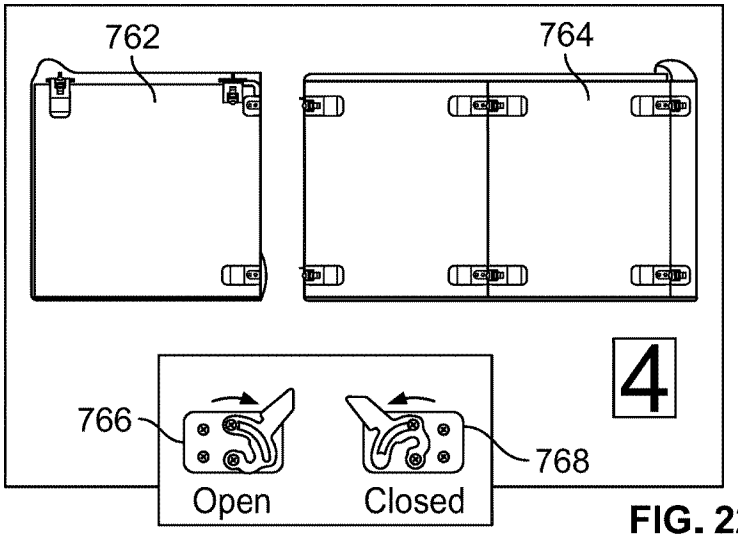
FIG. 22F is a perspective view of a fourth step of a second phase of a corner sectional assembly procedure, according to the embodiment of FIGS. 22A-22H
Figure 22H:
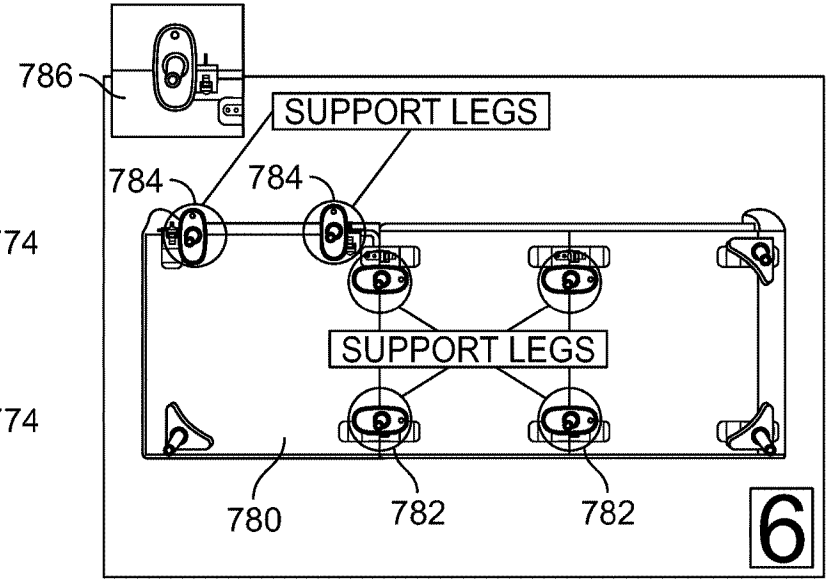
FIG. 22H is a perspective view of a sixth step of a second phase of a corner sectional assembly procedure, according to the embodiment of FIGS. 22A-22H.
Figure 22E:
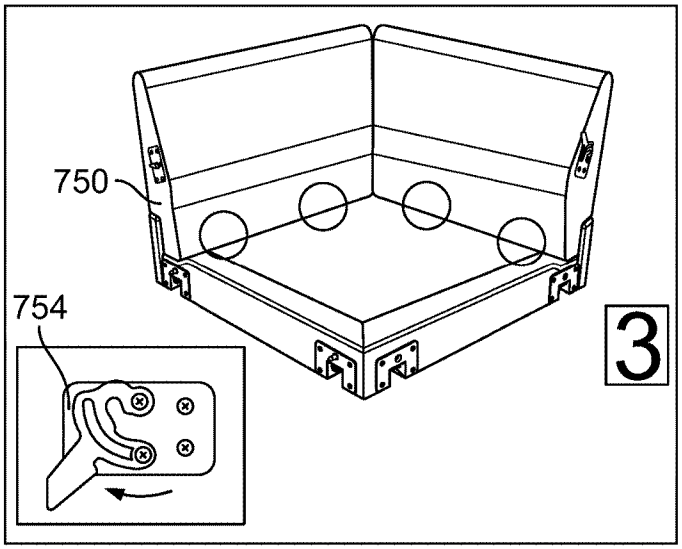
FIG. 22E is a further perspective view of a third step of a second phase of a corner sectional assembly procedure, according to the embodiment of FIGS. 22A-22H.
Figure 22G:
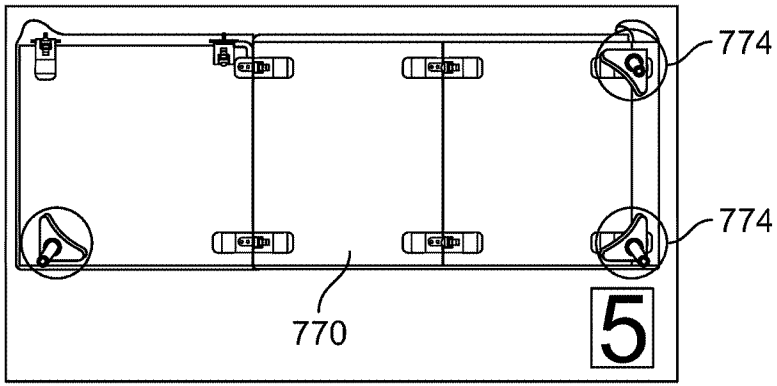
FIG. 22G is a perspective view of a fifth step of a second phase of a corner sectional assembly procedure, according to the embodiment of FIGS. 22A-22H.

In an embodiment, first corner back 430 includes a first set of inner back connectors 444, 446 at its inner edge surface 434, and second corner back 450 includes a second set of inner back connectors 464, 466 at its inner edge surface 434. In an embodiment, the back connectors form dowel joints. In an embodiment, each of the inner back connectors 464 and 466 includes a pin extending from the second inner side edge surface 454, while each of the inner back connectors 444, 446 includes a mating slot (not visible in FIG. 19) at the inner side edge surface 434. In an embodiment, the back connectors that include a slot also include a latch with a pivotally mounted lever having open and closed positions. The open position of the pivotally mounted lever permits sliding movement of the pin in the slot to slidingly join or slidingly separate the first corner back and the second corner back, while the closed position of the pivotally mounted lever locks the pin in a fully inserted position within the slot. Seating module 430 also includes an outer back connector 442 with pin at its outer side edge 432, and seating module 450 also includes an outer back connector 462 with slot and pivotally mounted lever at its outer side edge surface 452. In an embodiment, these corner module back connectors may have the same or similar configuration as the seating module back connectors 162, 164 shown in FIGS. 4A, 4B. During assembly of the corner module 400, the inner back connectors 444, 446, 464, 466 are configured to engage and secure corner back 430 to corner back 450 at their inner edges, as described above with respect to FIGS. 4A, 4C. During assembly of modular furniture (e.g., corner sectional) including an assembled corner module 400, the outer back connectors 442, 462 are configured to engage and secure the corner back 430 and corner back 450 respectively to mating back connectors adjacent furniture modules, e.g., as shown in FIGS. 22F, 22G.

Figure 20:
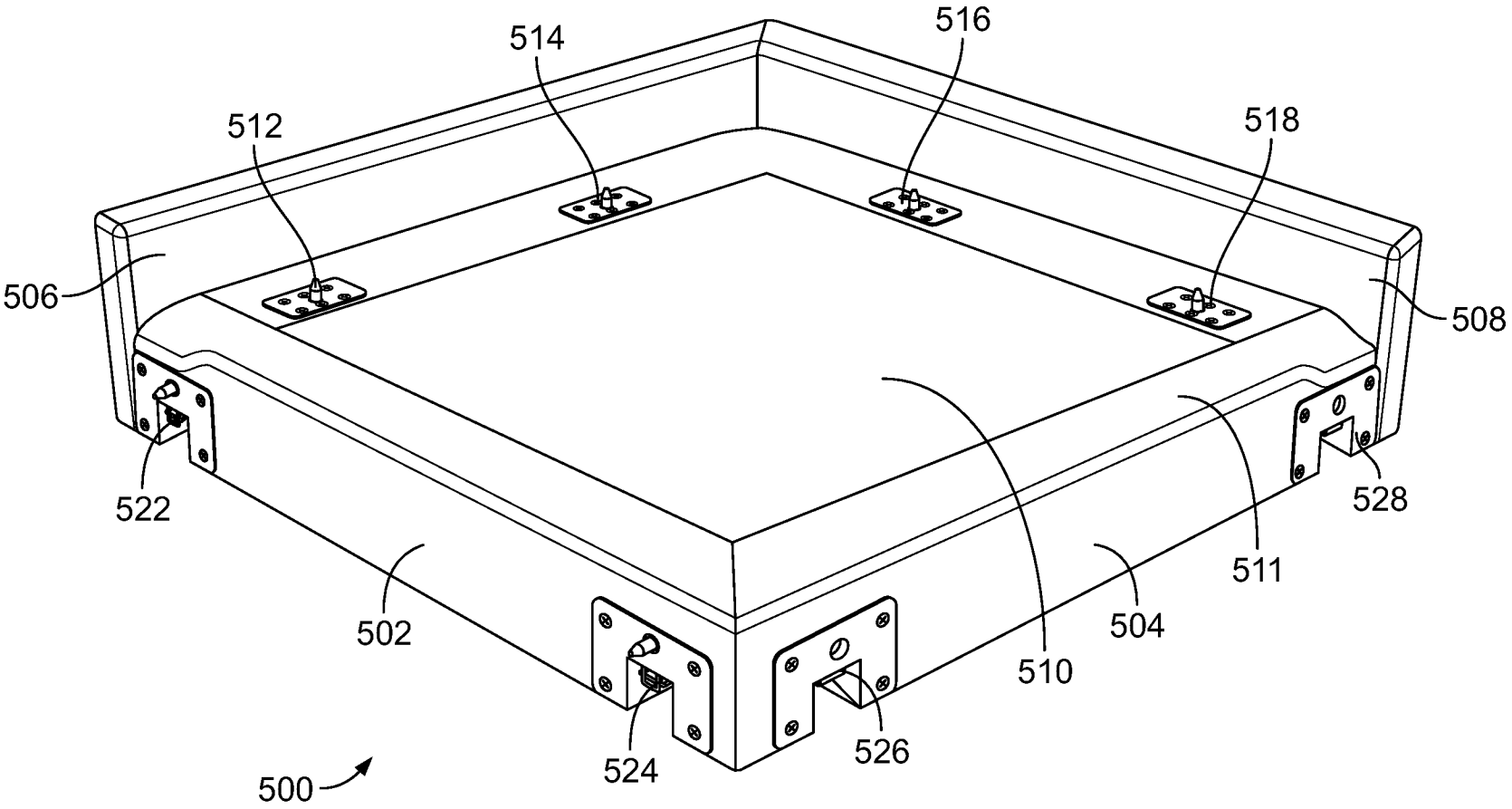
FIG. 20 is a perspective view of a corner base, according to an embodiment.

FIG. 19 shows structural components of corner module 400 without upholstery. Corner module 400 may serve as a corner section, or may form the frame of a corner section. In various embodiments, lower horizontal surface 420 defines or supports a seating surface of a corner section, i.e., surface 420 may itself serve as a seating surface or it may support another material such as upholstery that provides a seating surface. FIG. 20 shows an upholstered corner base 500 that may be assembled with upholstered corner backs and a seat cushion to create a corner section with comfortable seat and backrest surfaces. Side edges 502, 504, 506, 508 and upper peripheral surface 511 have upholstered surfaces, while inner base surface 510 may be formed of a resilient material for greater seating comfort. Corner base 500 includes upward-facing connectors 512, 514, 516, 518 corresponding to connectors 422, 424, 426, 428 of FIG. 19. Additionally, corner base 500 includes connectors 522, 524 at side edge 502, and connectors 526, 528 at side edge 514, also herein called corner seating connectors or base seating connectors. Connectors 524, 526 are located toward the front of the respective side edge surface, while connectors 522, 528 are located toward the back of the respective side edge surface. In an embodiment, connectors 522, 524, 526, 526 are dowel pin connectors located and configured for connection with mating connectors at seating side edge surfaces of adjacent furniture modules, such as the seating modules 110 of FIGS. 2, 3. In an embodiment, connector 522 and 524 include pins, while connectors 526 and 528 includes slots.

In an embodiment, corner seating connectors 522, 524, 526, 528 incorporate a latch mechanism for securing connection of a corner base of an assembled corner module to an adjacent furniture module. In an embodiment, the latch mechanism is a toggle latch mechanism at the bottom of corner base 500, such as the toggle match mechanism shown at FIGS. 5A, 5B. The toggle latch mechanism includes a hook (e.g., hook 143) configured to engage a mating catch or strike (e.g., catch 153). During assembly of modular furniture including an assembled corner module (e.g., a corner sectional), the corner seating connectors with latch mechanism engage and secure the corner base to mating seating connectors of an adjacent furniture module, e.g., as shown in FIG. 22F, 22G.

Figure 21:
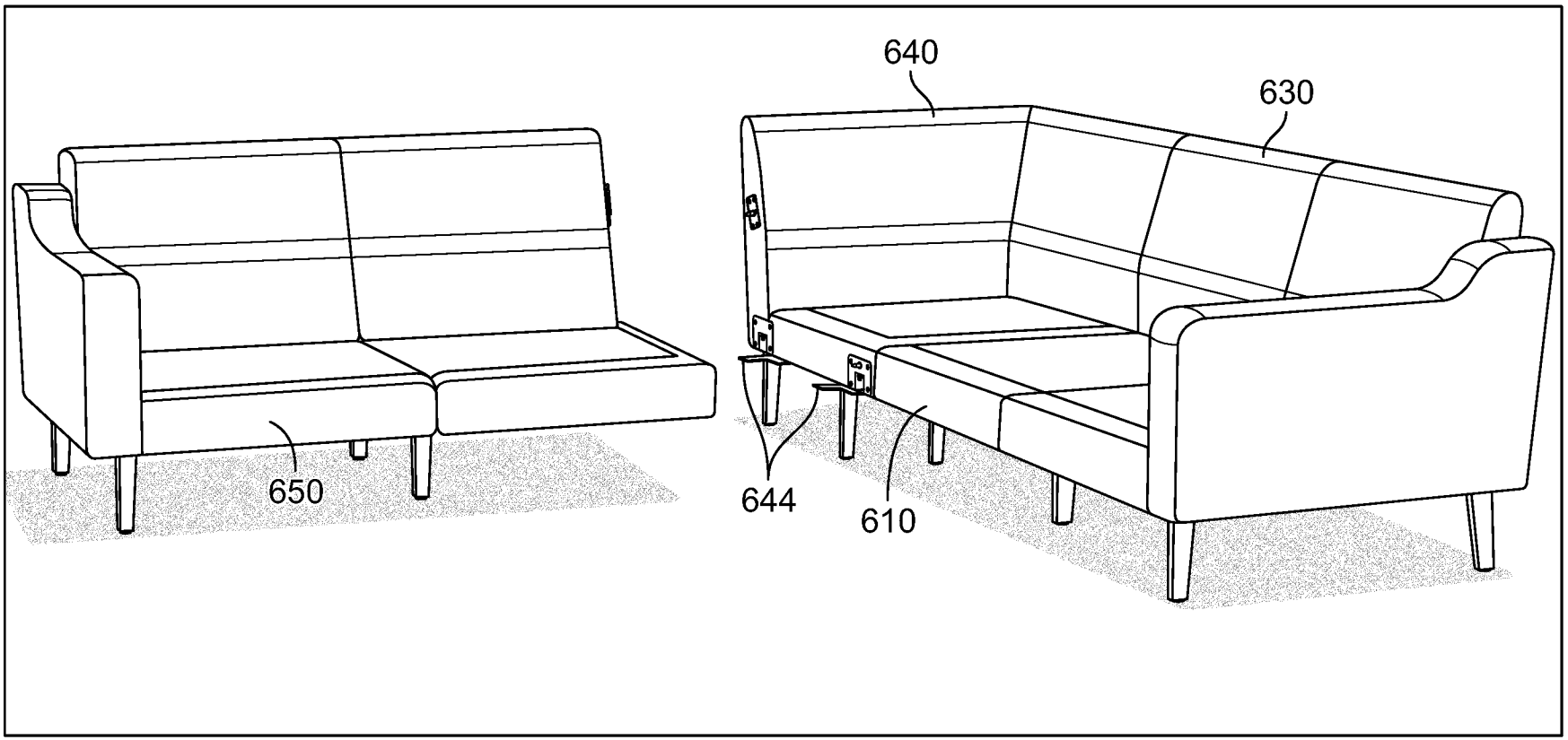
FIG. 21 is a perspective view of a corner sectional module with first and second sections partially assembled, according to an embodiment.

As shown in FIG. 21, a corner sectional sofa 600 includes two primary pieces or sections, a bench 610 with corner 640 attached (including a bench 630 and assembled corner 640), and a transversely oriented bench 650. In the present disclosure, bench 630 is also called corner bench, and base 650 is also called wing bench. In the illustrated embodiment for a five-seat corner sectional 600, each of benches 630 and 650 includes two seating modules and an armrest module, including a left armrest in bench 650 and a right armrest in bench 630. In another embodiment (not shown) for a seven-seat corner sectional, each of benches includes three seating modules and an armrest module.

An exemplary process for assembling a corner sectional sofa includes three stages. At the first stage, the user assembles benches 630 and 650, e.g., using the modular sofa assembly process shown at FIGS. 1A-1E. The user lines up the seat sections for the bench 630 (right side of sectional), then with the seat sections still in their folded position slides the seat sections together to close the dowel pin connectors using alignment pins and slots as a guide. The user closes both of the latches between each section (FIG. 1B). The user then unfolds the seating bench so that the backrest is lying flat and the seats are perpendicular to the ground, and closes the back connector lever between each backrest to secure the connection (FIG. 1C). The user attaches the right armrest to the bench 630 by closing the dowel pin connectors and closing both of the latches between the armrest and adjacent seating section (FIGS. 1D, 1E). The user repeats these steps to assemble the wing bench 650.

At the second assembly stage, the user assembles the corner module, and joins the corner module to the corner bench 630. FIGS. 22A-2211 shows an exemplary process (numbered as steps 1-6 in these figures) for assembling a corner module and for joining the corner module to the corner bench at this second stage. At step 1 (FIG. 22A), the user places the corner base 710 flat on the ground, near the open end of the corner bench assembled during the first stage. At step 2 (FIG. 22B), the user connects the two corner backs 722, 724 using the alignment pins as a guide, then closes 726 the levers at the gap between corner backs 722, 724. As shown at 736 in FIG. 22C, the levers are completely flush with the backrest when they are securely closed. At step 3 (FIG. 22D), the user presses down the joined backrest sections 742 against the connectors 744, 746 to secure the connection with the corner base 740. In an embodiment as shown FIG. 22E, the user applies downward force on the backrest sections 740 at the corners only.

At step 4 (FIG. 22E), the user tilts the corner module 762 on its back, and aligns it with the corner bench 764 with right facing armrest. The user slides these pieces together using the alignment pins and holes as guides. The latch levers between the corner module 762 and corner bench 764 should be in the open position 766 before connecting these pieces. The user then closes the latches 768, and ensures the levers are securely fastened before proceeding to the next step. At step 5 (FIG. 22F), the user securely attached the corner legs 774 to the bottom of the assembled corner and bench 770. At step 6 (FIG. 22G), the user completes attachment of support legs, e.g., using thumbscrews. The support legs include central support legs 782 and support legs 780 that "hang" over the edge of the corner bench. The user then lifts the corner bench onto its legs.

Figure 23A:
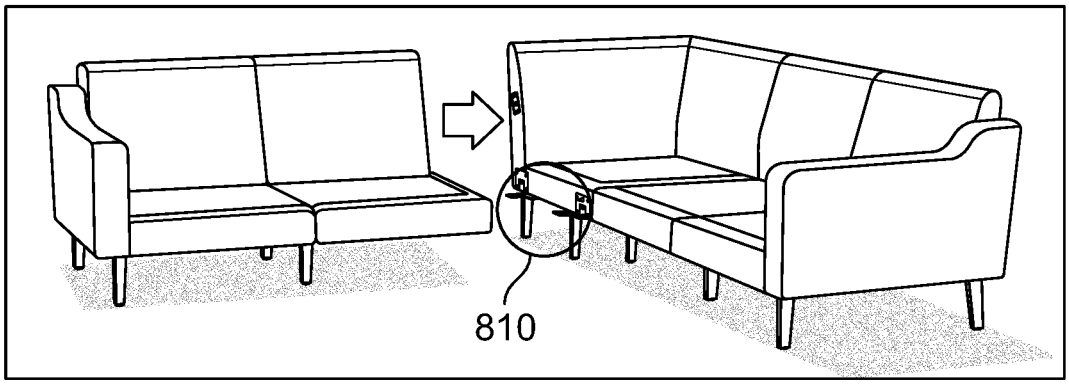
FIG. 23A is a perspective view of a first step of a third phase of a corner sectional assembly procedure.
Figure 23B:
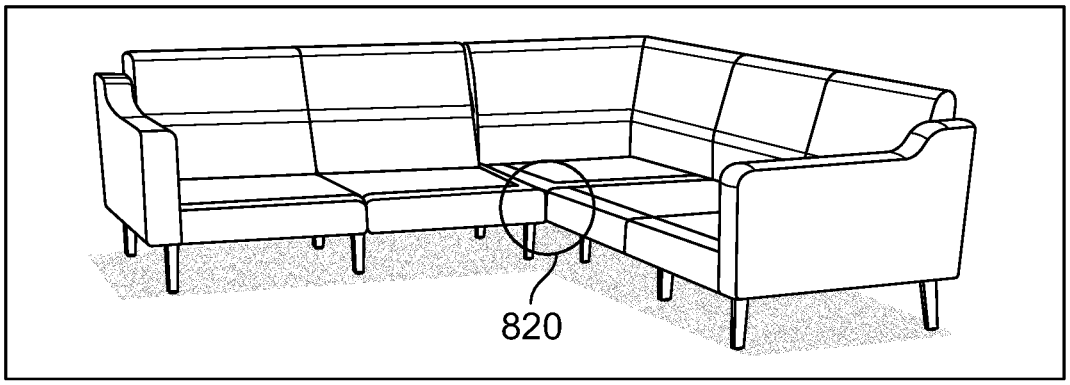
FIG. 23B is a perspective view of a second step of a third phase of a corner sectional assembly procedure, according to the embodiment of FIGS. 23A-23C.
Figure 23C:
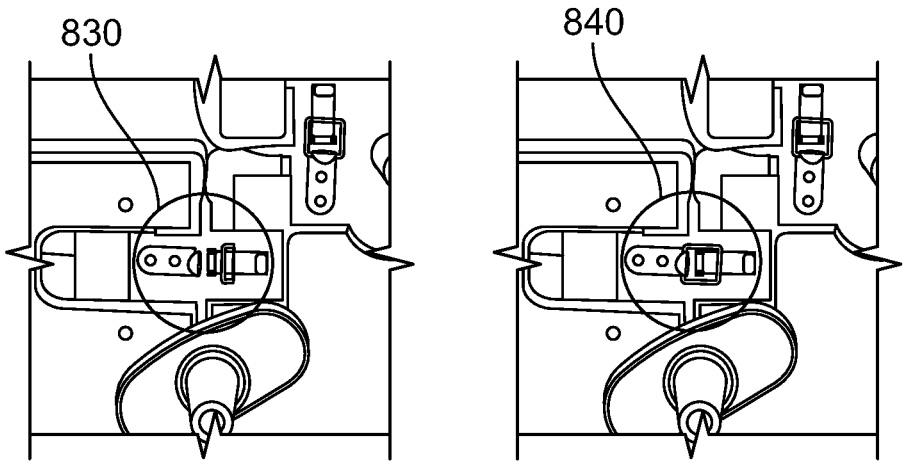
FIG. 23C is a perspective view of a third step of a third phase of a corner sectional assembly procedure, according to the embodiment of FIGS. 23A-23C.

At the third assembly stage, the user completes assembly of the wing bench and joins the wing bench to the corner bench to complete assembly of the corner sectional. At completion of stage two the corner bench 610 should have two support leg plates 644 protruding from the open side of the corner 640 (FIG. 21). The user attaches support legs to the wing bench 650 as was done for the corner bench, except no legs are attached to the open end of the bench. The wing bench 650 is turned over onto its legs, and the corner bench 610 is placed at its desired final location. The wing bench is then lifted and guided into place on top of the protruding leg plates 810 of the corner bench (FIG. 23A). Connector pins and holes are used as an alignment guide, as in prior connections. Once the corner bench and wing bench are flush and the pins are inserted into mating slots (FIG. 23B), the user works underneath the benches at the junction 820 to complete the assembly. In an embodiment, the user reaches up and connects the latches 830, 840 (FIG. 23C). The leg plates can be pivoted out of the way temporarily and the benches can be lifted slightly by another user for additional access room. When the latches and levers have been closed and secured, the user completes attachment of support legs to the wing section. The user may then assemble seat cushions, backrest cushions and any other furniture accessories.

Although the exemplary embodiments recite the use of furniture modules and connectors to form a sofa and a corner sectional, it is intended that the modules and connectors described herein can be used to form other types of furniture besides a sofa and a corner sectional, including seating surfaces, beds, tables, shelving, and the like. Components for furniture can utilize the connectors described herein to construct the furniture using modules that are coupled using these connectors.

While various aspects and embodiments have been disclosed, other aspects and embodiments are contemplated. The various aspects and embodiments disclosed are for purposes of illustration and are not intended to be limiting, with the true scope and spirit being indicated by the following claims.

The foregoing method descriptions and the interface configuration are provided merely as illustrative examples and are not intended to require or imply that the steps of the various embodiments must be performed in the order presented. As will be appreciated by one of skill in the art the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations can be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

What is claimed is:

1. A furniture module, comprising:

a base comprising a lower horizontal surface that defines or supports a seating surface of the base, and a plurality of edge walls extending upwardly from edges of the lower horizontal surface, wherein the base defines a substantially polygonal horizontal shape, wherein the plurality of edge walls comprise a first edge wall and a second edge wall that respectively define a first base side edge surface and a second base side edge surface adjacent a front corner of the substantially polygonal horizontal shape, and further comprise a third edge wall that defines a first guide surface and a fourth edge wall defines a second guide surface; and first and second sets of base connectors facing upwardly at the lower horizontal surface;

a first back member comprising a first backrest surface, a first inner side edge surface, a first mounting portion, and a first set of back connectors facing downwardly from a lower portion of the first back member, wherein the first back member is configured to be secured to the base by lowering the first back member to bring the first mounting portion into mating engagement with the first guide surface of the third edge wall and to secure the first set of back connectors to the first set of base connectors; and a second back member comprising a second backrest surface, a second inner side edge surface, a second mounting portion, and a second set of back connectors facing downwardly from a lower portion of the second back member, wherein the second back member is configured to be secured to the base by lowering the second back member to bring the second mounting portion into mating engagement with the second guide surface of the fourth edge wall and to secure the second set of back connectors to the second set of base connectors.

2. The furniture module as defined in claim 1, wherein the first back member defines a first inner side edge surface and the second back member defines a second inner side edge surface, wherein the first back member and the second back member respectively include first and second back connectors configured to be joined to each other with the first inner side surface abutting against second inner side edge surface during the securing the first back member and the second back member to the base.

3. The furniture module as defined in claim 2, wherein the first back connector comprises a pin extending from the first inner side edge surface, and the second back connector comprises a slot extending into the second inner side edge surface.

4. The furniture module as defined in claim 3, wherein the second back connector further comprises a lever clip assembly at the second inner side edge surface including a pivotally mounted lever with open and closed positions, wherein the open position of the pivotally mounted lever permits sliding movement of the pin in the slot to slidingly join or slidingly separate the first module and the second module, and the closed position of the pivotally mounted lever locks the pin in a fully inserted position within the slot.

5. The furniture module as defined in claim 1, wherein the first base side edge surface and the second base side edge surface each is configured for mating engagement with a seating side edge surface of a respective adjacent seating module, and the first base side edge surface and the second base side edge surface each includes a plurality of seating connectors configured for mating engagement with the respective adjacent seating module.

6. The furniture module as defined in claim 5, wherein each of the plurality seating connectors further comprises a first toggle latch configured for secured engagement with a second toggle latch of the respective adjacent seating module.

7. The furniture module of claim 6, wherein the one of the first toggle latch and the second toggle latch is a hook, and the other of the first toggle latch and the second toggle latch is a mating catch.

8. The furniture module as defined in claim 1, wherein the first back member defines a first outer side edge surface and the second seating module defines a second outer side edge surface, wherein the first back member and the second back member respectively include first and second back connectors configured to be joined to back connectors of a respective adjacent seating module.

9. The furniture module as defined in claim 8, wherein the first back connector comprises one of a pin extending from the first outer side edge surface or a slot extending into the first outer side edge surface, and the back connector of the adjacent seating module comprises the other of a pin extending from a side edge surface of the respective adjacent seating module or a slot extending into the side edge surface of the respective adjacent seating module.

10. The furniture module as defined in claim 9, wherein the first back connector comprises a lever clip assembly at the first outer side edge surface including a pivotally mounted lever with open and closed positions, wherein the open position of the pivotally mounted lever permits sliding movement of the pin in the slot, and the closed position of the pivotally mounted lever locks the pin in a fully inserted position within the slot.

11. The furniture module as defined in claim 1, wherein the base defines a substantially square horizontal shape.

12. A furniture module, comprising:

a base comprising a lower horizontal surface that defines or supports a seating surface of the base, wherein the base defines a substantially square horizontal shape; a first edge wall and a second edge wall that respectively define a first base side edge surface and a second base side edge surface that adjoin a front corner of the substantially square horizontal shape; a first support member and a second support member extending upwardly from the lower horizontal surface; and first and second sets of base connectors facing upwardly at the lower horizontal surface;

a first back member comprising a first backrest surface, a first mounting portion, and a first set of back connectors facing downwardly from a lower portion of the first back member, wherein the first back member is configured to be secured to the base by lowering the first back member to bring the first mounting portion into mating engagement with the first support member and to secure the first set of back connectors to the first set of base connectors; and a second back member comprising a second backrest surface, a second mounting portion, and a second set of back connectors facing downwardly from a lower portion of the second back member, wherein the second back member is configured to be secured to the base by lowering the second back member to bring the second mounting portion into mating engagement with the second support member and to secure the second set of back connectors to the second set of base connectors.

13. The furniture module as defined in claim 12, wherein each of the first support member and the second support member comprises an edge wall extending upwardly from a respective edge of the lower horizontal surface.

14. The furniture module as defined in claim 12, wherein the first back member defines a first inner side edge surface and the second back member defines a second inner side edge surface, wherein the first back member and the second back member respectively include first and second back connectors configured to be joined to each other with the first inner side surface abutting against second inner side edge surface during the securing the first back member and the second back member to the base.

15. The furniture module as defined in claim 14, wherein the first back connector comprises a pin extending from the first inner side edge surface, and the second back connector comprises a slot extending into the second inner side edge surface.

16. The furniture module as defined in claim 15, wherein the second back connector further comprises a lever clip assembly at the second inner side edge surface including a pivotally mounted lever with open and closed positions, wherein the open position of the pivotally mounted lever permits sliding movement of the pin in the slot, and the closed position of the pivotally mounted lever locks the pin in a fully inserted position within the slot.

17. The furniture module as defined in claim 15, wherein each of the plurality seating connectors further comprises a first toggle latch configured for secured engagement with a second toggle latch of the respective adjacent seating module.

18. The furniture module as defined in claim 12, wherein the first base side edge surface and the second base side edge surface each is configured for mating engagement with a seating side edge surface of a respective adjacent seating module, and the first base side edge surface and the second base side edge surface each includes a plurality of seating connectors configured for mating engagement with the respective adjacent seating module.

19. A modular furniture, comprising:

a corner module, comprising a base comprising a lower horizontal surface that defines or supports a seating surface of the base, wherein the base defines a substantially square horizontal shape; an edge wall that defines a base side edge surface; a first set of base connectors and a second set of base connectors facing upwardly at the lower horizontal surface; and a first set of seating connectors at the base side edge surface;

a first back member comprising a first backrest surface and a first set of back connectors facing downwardly from a lower portion of the first back member, wherein the first back member is configured to be secured to the base by securing the first set of back connectors to the first set of base connectors; and a second back member comprising a second backrest surface and a second set of back connectors facing downwardly from a lower portion of the second back member, wherein the second back member is configured to be secured to the base by securing the second set of back connectors to the second set of base connectors; and a seating module comprising a seat section and a backrest section, wherein the seating module includes a second set of seating connectors at a seating side edge surface of the seating module, wherein the seating side edge surface is configured for mating engagement with the base side edge surface of the corner module, and the second set of seating connectors are configured for sliding movement relative to the first set of seating connectors to slidingly join or slidingly separate the corner module and the seating module.

* * * * *